US011532283B2

(12) United States Patent
Jang et al.

(10) Patent No.: US 11,532,283 B2
(45) Date of Patent: Dec. 20, 2022

(54) DISPLAY DEVICE AND IMAGE PROCESSING METHOD THEREOF

(71) Applicant: LG Display Co., Ltd., Seoul (KR)

(72) Inventors: Hae Jong Jang, Paju-si (KR); Ji Hye Koo, Paju-si (KR)

(73) Assignee: LG Display, Co., Ltd., Seoul (KR)

( * ) Notice: Subject to any disclaimer, the term of this patent is extended or adjusted under 35 U.S.C. 154(b) by 0 days.

(21) Appl. No.: 17/521,662

(22) Filed: Nov. 8, 2021

(65) Prior Publication Data

US 2022/0148522 A1 May 12, 2022

(30) Foreign Application Priority Data

Nov. 9, 2020 (KR) ..... 10-2020-0148429

(51) Int. Cl.
*G09G 3/3291* (2016.01)

(52) U.S. Cl.
CPC ... *G09G 3/3291* (2013.01); *G09G 2300/0413* (2013.01); *G09G 2310/027* (2013.01); *G09G 2320/0238* (2013.01)

(58) Field of Classification Search
CPC ..... G09G 2320/046; G09G 2320/043; G09G 2320/0626; G09G 2320/0233; G09G 2320/048; G09G 2320/0257; G09G 2360/16; G09G 3/3208; G09G 3/3233; G09G 2340/0464
See application file for complete search history.

(56) References Cited

U.S. PATENT DOCUMENTS

| | | | | |
|---|---|---|---|---|
| 10,706,763 | B2 | 7/2020 | Chun | |
| 10,706,785 | B2 | 7/2020 | Kim | |
| 2015/0187277 | A1* | 7/2015 | Maeyama | G09G 3/3225 345/694 |
| 2017/0221455 | A1* | 8/2017 | Lee | G06T 3/20 |
| 2018/0286339 | A1* | 10/2018 | Kou | G09G 3/2096 |
| 2019/0035342 | A1* | 1/2019 | Ito | G09G 3/3607 |
| 2019/0043399 | A1* | 2/2019 | Zhuang | G09G 3/007 |
| 2021/0035524 | A1* | 2/2021 | Chun | G09G 3/29 |

FOREIGN PATENT DOCUMENTS

| | | | |
|---|---|---|---|
| KR | 10-2018-0013527 | A | 2/2018 |
| KR | 10-2019-0058124 | A | 5/2019 |
| KR | 10-2019-0079241 | A | 7/2019 |

* cited by examiner

*Primary Examiner* — Dong Hui Liang
(74) *Attorney, Agent, or Firm* — Seed IP Law Group LLP

(57) ABSTRACT

The present disclosure relates to a display device and an image processing method thereof, and includes a pixel shift processing unit configured to shift an image displayed in an active pixel region within the size of a dummy pixel region. The pixel shift processing unit gradually changes a gray level of at least one dummy pixel in the dummy pixel region adjacent to the active pixel region up to a target gray level of pixel data, and gradually changes a gray level of at least one active pixel of an active pixel adjacent to the dummy pixel region up to a black gray level when the active pixel region is shifted.

17 Claims, 29 Drawing Sheets

FIG. 17

TGR

| | | | |
|---|---|---|---|
| 10 Frame | 1STEP | 2STEP | 3STEP |
| 11~20 Frame | 2STEP | 3STEP | 4STEP |
| 21~30 Frame | 3STEP | 4STEP | 5STEP |
| 31~40 Frame | 4STEP | 5STEP | 6STEP |

SHP STEP

FIG. 18

TGR

| | | | |
|---|---|---|---|
| 10 Frame | 2STEP | 4STEP | 6STEP |
| 11~20 Frame | 4STEP | 6STEP | 8STEP |
| 21~30 Frame | 6STEP | 8STEP | 10STEP |

SHP STEP

DISPLAY DEVICE AND IMAGE PROCESSING METHOD THEREOF

CROSS-REFERENCE TO RELATED APPLICATION

This application claims priority to and the benefit of Korean Patent Application No. 10-2020-0148429, filed Nov. 9, 2020, the disclosure of which is incorporated herein by reference in its entirety.

BACKGROUND

Technical Field

The present disclosure relates to a display device for stepwise shifting an image reproduced on a screen of a display panel, and an image processing method thereof.

Description of the Related Art

An electroluminescent display device is roughly classified into an inorganic light emitting display device and an organic light emitting display device depending on the material of a light emitting layer. The organic light emitting display device of an active matrix type includes an Organic Light Emitting Diode (hereinafter referred to as "OLED") that emits light by itself, and has an advantage that the response speed is fast, and the luminous efficiency, luminance and viewing angle are large. In the organic light emitting display device, a light emitting diode element (OLED) is formed on each of the pixels. The organic light emitting display device has a high response speed, excellent luminous efficiency, luminous, viewing angle, and the like, and is capable of expressing black gradation in complete black, thereby providing excellent contrast ratio and color reproduction.

The organic light emitting display device does not require a backlight unit, and may be implemented on a plastic substrate, which is a flexible material, a thin glass substrate, or a metal substrate. Therefore, the organic light emitting display device may be implemented as a flexible display.

BRIEF SUMMARY

In the organic light emitting display device, when data values of pixels are maintained for a long time, an afterimage may occur. In particular, the inventors have identified and appreciated that when the gray scale of pixels is maintained at a high gray scale value for a long time, the deterioration of the pixels may be accelerated and a burn-in phenomenon may occur. The burn-in phenomenon is a non-restored afterimage in which pixels displaying a fixed pattern (e.g., text, image, etc.) for a long time in an organic light emitting display device are deteriorated, and the previous pattern is visible even if another image is displayed on the pixels.

One or more embodiments of the present disclosure addresses the aforementioned technical problems as well as other problems in the related art.

In particular, the present disclosure provides a display device in which afterimages and deterioration of pixels are prevented and movement of an image on a screen is not visually recognized, and an image processing method thereof.

It should be noted that the technical benefits of the present disclosure are not limited to the above-described benefits, and other benefits of the present disclosure will be apparent to those skilled in the art from the following descriptions.

According to an aspect of the present disclosure, there is provided a display device comprising: a display panel including an active pixel region in which an input image is displayed and a dummy pixel region outside the active pixel region; and a pixel shift processing unit configured to shift an image displayed in the active pixel region within the dummy pixel region.

The pixel shift processing unit may gradually change a gray scale of at least one dummy pixel in the dummy pixel region adjacent to the active pixel region up to a target gray scale of pixel data when the active pixel region is shifted.

The pixel shift processing unit may gradually change a gray scale of at least one active pixel of an active pixel adjacent to the dummy pixel region up to a black gray scale.

According to another aspect of the present disclosure, there is provided an image processing method of a display device, comprising: displaying an input image in an active pixel region; displaying black gray scale data in a dummy pixel region arranged outside the active pixel region; gradually changing a gray scale of at least one dummy pixel in the dummy pixel region adjacent to the active pixel region up to a target gray scale of pixel data when the active pixel region is shifted; and gradually changing a gray scale of at least one active pixel of an active pixel adjacent to the dummy pixel region up to a black gray scale.

According to the present disclosure, a screen may be divided into an active pixel region and a dummy pixel region and an image displayed in the active pixel region may be moved, thereby preventing afterimages and deterioration of pixels.

According to the present disclosure, when the active pixel region is shifted, the difference in gray scale of the pixels at the boundary between the active pixel region and the dummy pixel region gradually may be changed, thereby lowering the probability that the user recognizes the movement of the image on the screen to improve the visibility of the image movement.

Further, according to the present disclosure, at least one of the pixel shift amount and the pixel shift period may be varied based on the analysis result of the image, thereby further lowering the recognition probability of the image movement.

Effects of the present disclosure are not limited to the above-described effects, and other effects which are not mentioned can be apparently understood by those skilled in the art from a disclosure of claims.

BRIEF DESCRIPTION OF THE SEVERAL VIEWS OF THE DRAWINGS

The above and other features, and advantages of the present disclosure will become more apparent to those of ordinary skill in the art by describing embodiments thereof in detail with reference to the attached drawings, in which:

FIG. 17 is a diagram illustrating an example of a lookup table in which a pixel shift period of an active pixel region is set;

FIG. 18 is a diagram illustrating another example of a lookup table in which a pixel shift period of an active pixel region is set;

DETAILED DESCRIPTION

Figure 1:
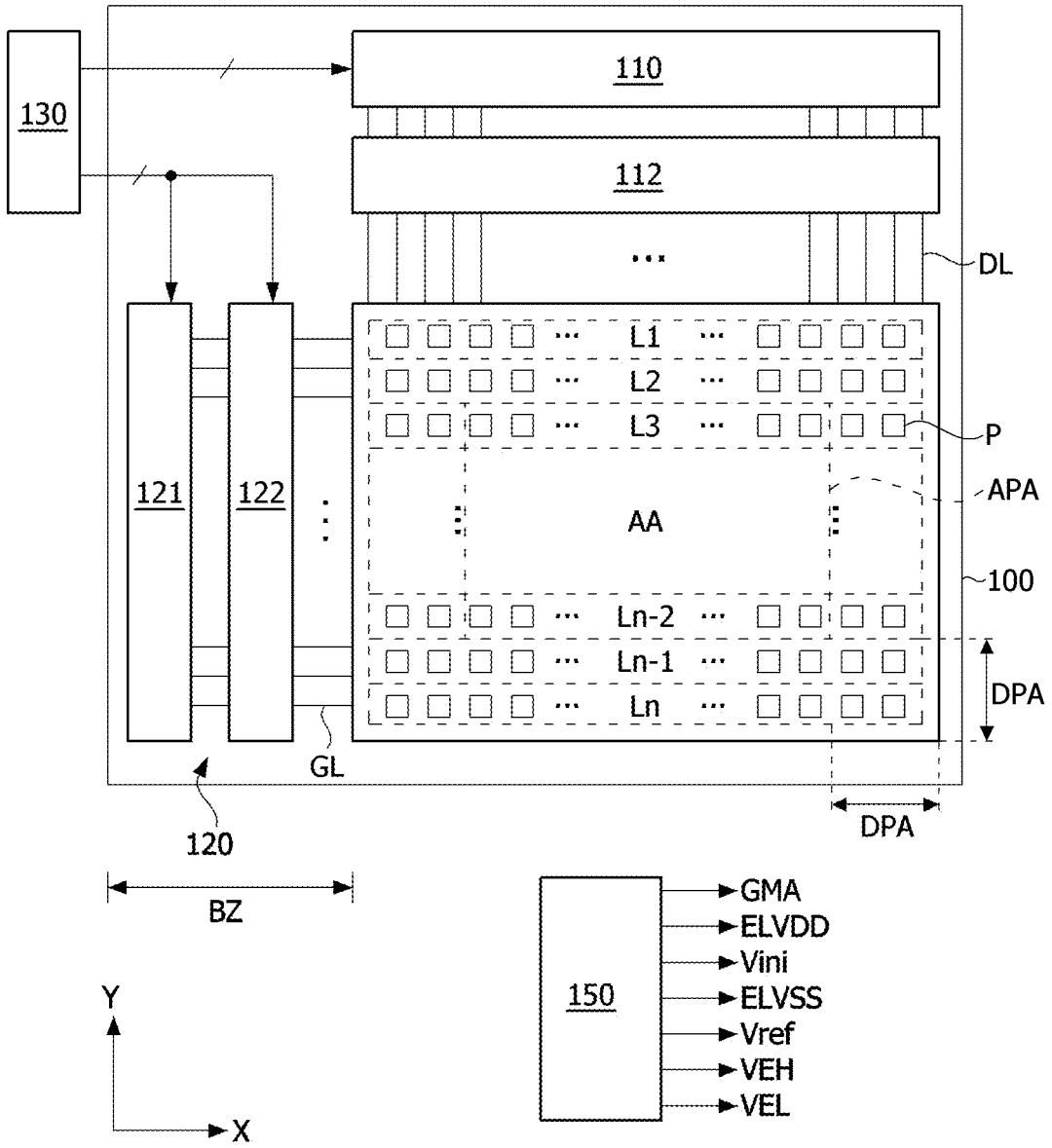
FIGS. 1 and 2 are block diagrams showing a display device according to an embodiment of the present disclosure.

The advantages and features of the present disclosure and methods for accomplishing the same will be more clearly understood from embodiments described below with reference to the accompanying drawings. However, the present disclosure is not limited to the following embodiments but may be implemented in various different forms. Rather, the present embodiments will make the disclosure of the present disclosure complete and allow those skilled in the art to completely comprehend the scope of the present disclosure.

The shapes, sizes, ratios, angles, numbers, and the like illustrated in the accompanying drawings for describing the embodiments of the present disclosure are merely examples, and the present disclosure is not limited thereto. Like reference numerals generally denote like elements throughout the present specification. Further, in describing the present disclosure, detailed descriptions of known related technologies may be omitted to avoid unnecessarily obscuring the subject matter of the present disclosure.

The terms such as "comprising," "including," "having" used herein are generally intended to allow other components to be added unless the terms are used with the term "only." Any references to singular may include plural unless expressly stated otherwise.

Components are interpreted to include an ordinary error range even if not expressly stated.

When the position relation between two components is described using the terms such as "on," "above," "below," and "next," one or more components may be positioned between the two components unless the terms are used with the term "immediately" or "directly."

The terms "first," "second," and the like may be used to distinguish components from each other, but the functions or structures of the components are not limited by ordinal numbers or component names in front of the components.

The term "unit" may include any electrical circuitry, features, components, an assembly of electronic components or the like. That is, "unit" may include any processor-based or microprocessor-based system including systems using microcontrollers, integrated circuit, chip, microchip, reduced instruction set computers (RISC), application specific integrated circuits (ASICs), field-programmable gate arrays (FPGAs), graphical processing units (GPUs), logic circuits, and any other circuit or processor capable of executing the various operations and functions described herein. The above examples are examples only, and are thus not intended to limit in any way the definition or meaning of the term "unit." In some embodiments, the various units described herein may be included in or otherwise implemented by processing circuitry such as a microprocessor, microcontroller, or the like.

The same reference numerals refer to the same elements throughout the description.

The following embodiments can be partially or entirely bonded to or combined with each other and can be linked and operated in technically various ways. The embodiments can be carried out independently of or in association with each other.

In the display device of the present disclosure, the pixel circuit and the gate driving unit may include a plurality of transistors. The transistors may be implemented as oxide thin film transistors (TFTs) including an oxide semiconductor, LTPS TFTs including low temperature polysilicon (LTPS), or the like. Each of the transistors may be implemented as a p-channel TFT or an n-channel TFT. In the description of embodiments, the transistors of the pixel circuit are described based on an example in which the transistors of the pixel circuit are implemented as p-channel TFTs, but the present disclosure is not limited thereto.

The transistor is a three-electrode element including a gate, a source, and a drain. The source is an electrode which supplies carriers to the transistor. In the transistor, the carriers start flowing from the source. The drain is an electrode through which the carriers exit from the transistor. In the transistor, the carriers flow from the source to the drain. In the case of the n-channel transistor (NMOS), since the carriers are electrons, a source voltage is lower than a drain voltage so that the electrons may flow from the source to the drain. In the case of the n-channel transistor, current flows in a direction from the drain to the source. In the case of the p-channel transistor (PMOS), since the carriers are holes, a source voltage is higher than a drain voltage so that the holes may flow from the source to the drain. In the p-channel transistor, since the holes flow from the source to the drain, current flows from the source to the drain. It should be noted that the source and drain of the transistor are not fixed. For example, the source and drain may be changed according to the applied voltage. Accordingly, the disclosure is not limited due to the source and drain of the transistor. In the following description, the source and drain of the transistor will be referred to as first and second electrodes.

The gate signal swings between the gate-on voltage and the gate-off voltage. The gate-on voltage is set to a voltage higher than the threshold voltage of the transistor, and the gate-off voltage is set to a voltage lower than the threshold voltage of the transistor. The transistor is turned on in response to the gate-on voltage, and is turned off in response to the gate-off voltage. In the case of the n-channel transistor, the gate-on voltage may be a gate high voltage VGH/VEH and the gate-off voltage may be a gate low voltage VGL/VEL. In the case of the p-channel transistor, the gate-on voltage may be the gate low voltage VGL/VEL, and the gate-off voltage may be the gate high voltage VGH/VEH.

Hereinafter, various embodiments of the present disclosure will be described in detail with reference to the accompanying drawings.

Figure 2:
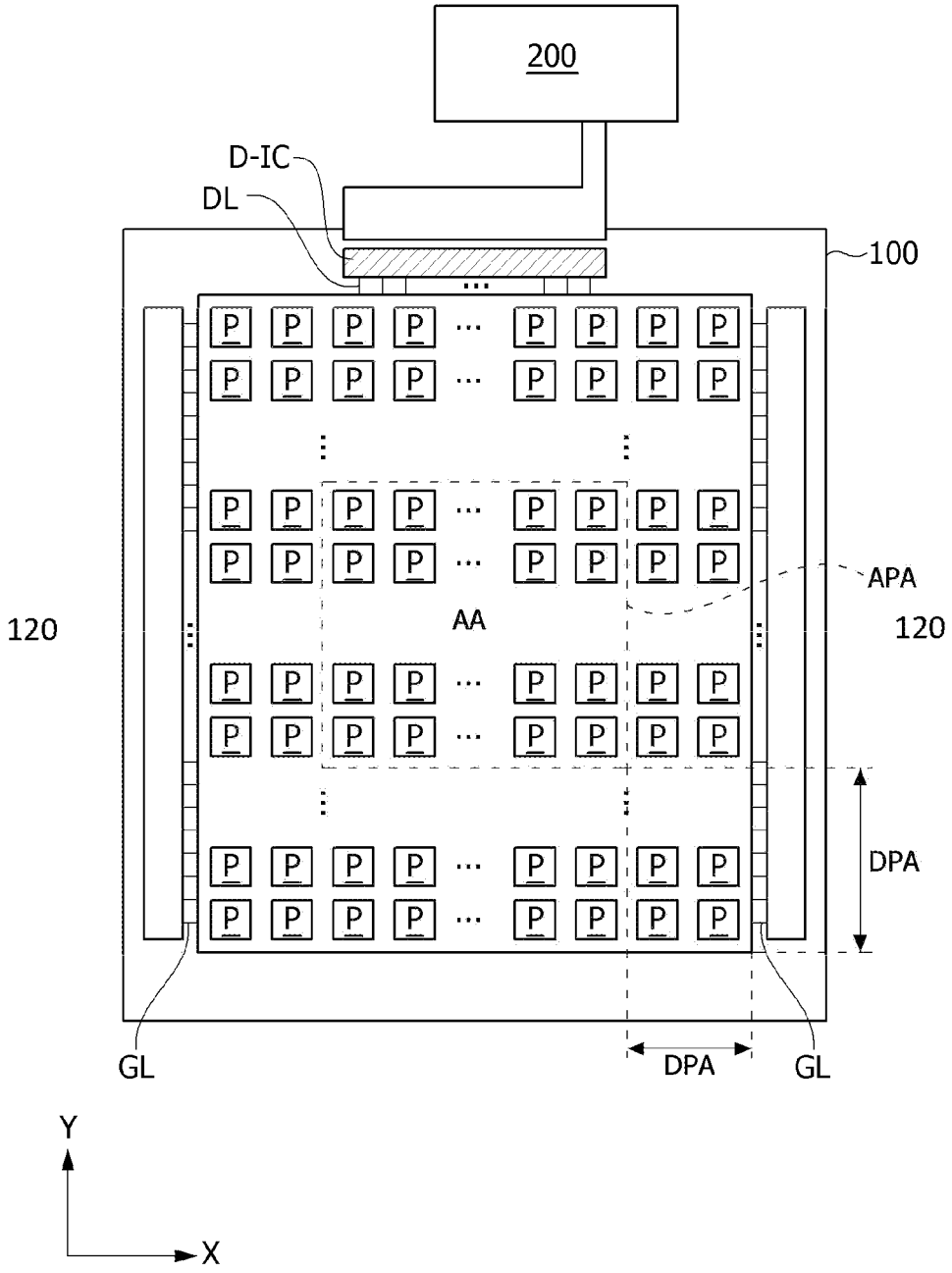

FIG. 1 is a block diagram showing a display device according to an embodiment of the present disclosure. FIG. 2 is a diagram schematically showing some pixels and wirings of a pixel array. In FIG. 2, power lines are omitted.

Referring to FIGS. 1 and 2, a display device according to an embodiment of the present disclosure includes a display panel 100 and a display panel driver for writing pixel data of an input image to pixels of the display panel 100.

The display panel 100 includes a pixel array AA that displays an input image on a screen. The pixel array AA includes a plurality of data lines DL, a plurality of gate lines GL intersected with the data lines DL, pixels P arranged in a matrix form defined by the data lines DL and the gate lines GL.

Each of the pixels P may be divided into a red sub-pixel, a green sub-pixel, and a blue sub-pixel for color implementation. Each of the pixels may further include a white sub-pixel. Each of the sub-pixels includes a pixel circuit driving a light emitting element OLED. The pixel circuit includes a light emitting element OLED, a driving element that drives the light emitting element OLED by controlling the current flowing through the light emitting element OLED according to a gate-source voltage Vgs, a storage capacitor that maintains a gate voltage of the driving element, and the like. The driving element may be implemented as a transistor.

The sub-pixels may include a color filter, but may be omitted. Hereinafter, the pixel may be interpreted as having the same meaning as a sub-pixel.

The pixel array AA includes a plurality of pixel lines L1 to Ln. The pixel line includes pixels arranged on one line disposed along a row line direction (X-axis direction). When the resolution of the pixel array is m*n, the pixel array includes n pixel lines L1 to L(N). The pixels arranged on one-pixel line share gate lines and are connected to different data lines DL. The sub-pixels arranged vertically along the column direction (Y-axis direction) share the same data line.

The pixel array AA includes an active pixel region APA in which an image is displayed, and a dummy pixel region DPA outside the active pixel region AA. Hereinafter, a pixel in which pixel data is written in the active pixel region APA is referred to as an "active pixel", and a pixel in the dummy pixel region DPA is referred to as a "dummy pixel".

In terms of expression, a dummy pixel is to be distinguished from a pixel in the active pixel region APA, and refers to a pixel belonging to the dummy pixel region DPA outside the active pixel region APA. The active pixel and the dummy pixel may be implemented with the same pixel structure and pixel circuit. The active pixel and the dummy pixel may be classified according to data written to the pixels. A pixel to which pixel data of the input image is written is an active pixel, and a pixel to which the dummy data (black gray level data) is written is a dummy pixel.

When pixel data of the input image is written to a dummy pixel, light is emitted with a brightness corresponding to a target gray level value of the pixel data. The active pixel and the dummy pixel are adjacent to the boundary between the active pixel region APA and the dummy pixel region DPA. The active pixel at the boundary may belong to the dummy pixel region APA when the active pixel region APA is shifted, and in this case, the active pixel changes to a dummy pixel to which black gray level data is written. Therefore, when the active pixel region APA is shifted and an image is moved on the screen, among the pixels at the boundary between the active pixel region APA and the dummy pixel region DPA, the active pixel changes to a dummy pixel, while the dummy pixel may be changed to an active pixel.

The pixel data of the input image is written to the pixels P of the active pixel region APA. The data voltage of one-line data is charged to the pixels of one-pixel line during one horizontal period 1H, so that pixel data is written to the pixels of one-pixel line. During one vertical period (or frame period), pixel data is written to all of the pixel lines L1 to Ln of the active pixel region APA.

In order to prevent afterimages on the screen of the display panel 100 and to lower the acceleration of deterioration of pixels, the active pixel region APA in which an image is displayed under the control of the timing controller 130 is shifted within the width of the dummy pixel region DPA. The dummy pixels are located outside the active pixel region in which the image is displayed on the pixel array AA, but when the active pixel region APA is shifted, the data voltage of the pixel data whose gray level value gradually changes from the black gray level to the target gray level of the pixel data may be charged to the active pixel. The pixels at the boundary of the active pixel region DPA in the direction opposite to the shift direction of the active pixel region DPA may be gradually changed from the gray level of the pixel data to the black gray level to be changed into the dummy pixel when the active pixel region APA is shifted.

The black gray level is a minimum gray level value of 0 (zero) in which the light emitting device OLED of the pixel is turned off and looks black. On the other hand, the white gray level is a maximum gray level value at which the light-emitting element OLED of the pixel is turned on with the maximum brightness.

Touch sensors may be disposed on the screen of the display panel 100. The touch sensors may be implemented as In-cell type touch sensors that are disposed on the screen of the display panel in an On-cell type or an Add-on type, or embedded in a pixel array.

The display panel 100 may be implemented as a flexible display panel in which pixels are arranged on a flexible substrate such as a plastic substrate or a metal substrate. In the flexible display, the size and shape of the screen may be varied by winding, folding, and bending the flexible display panel. The flexible display may include a slideable display, a rollable display, a bendable display, a foldable display, and the like.

Due to the process deviation and device characteristic deviation caused in the manufacturing process of the display panel, there may be a difference in electrical characteristics of the driving element between pixels, and this difference may increase as the driving time of the pixels P elapses. In order to compensate for the electrical characteristic deviation of the driving element between pixels P, an internal compensation technology or an external compensation technology may be applied to the organic light emitting display device.

In the internal compensation technology, a threshold voltage of a driving element is sensed for each sub-pixel using an internal compensation circuit embedded in each of the pixels P, and the gate-source voltage Vgs of the driving element is compensated by the threshold voltage. The external compensation technology uses an external compensation circuit to sense a current or voltage of a driving element that changes according to electrical characteristics of the driving elements in real time. The external compensation technology modulates pixel data (digital data) of an input image as much as the electrical characteristic deviation (or variation) of the driving element sensed for each pixel, thereby compensating the electrical characteristic deviation (or variation) of the driving element in each of the pixels P in real time. The display panel driver may drive pixels by applying an internal compensation technology and/or an external compensation technology.

The display panel driver reproduces the input image on the pixel array AA of the display panel 100 by writing pixel data of the input image into sub-pixels. The display panel driver includes a data driving unit 110, a gate driving unit 120, and a timing controller 130. The display panel driver may further include a demultiplexer 112 disposed between the data driving unit 110 and the data lines DL. In addition, the display panel driver may further include a touch sensor driving unit. The touch sensor driving unit drives the touch sensors, compares the output signals of the touch sensors with a preset (or selected) threshold value to determine a touch input, and transmits coordinate data of the touch input to a host system.

The display panel driver may operate in a low speed driving mode. The low-speed driving mode may analyze an input image to reduce power consumption of the display device when the input image is not varied as much as a preset (or selected) time or a touch input is not occurred for a predetermined (or selected) time or longer. In the low speed driving mode, when a still image is input for a certain time or longer, a refresh rate of the pixels may be lowered, thereby controlling a period of writing data of the pixels to a long time, and thereby reducing power consumption. The low speed driving mode is not limited when a still image is input. For example, when the display device operates in a standby mode or when a user command or an input image is not input to the display panel driver for a predetermined (or selected) time or longer, the display panel driver may operate in the low speed driving mode.

The data driving unit 110 converts data received from the timing controller 130 into a gamma compensation voltage using a digital to analog converter (hereinafter referred to as "DAC") to generate a data voltage Vdata. The data may include pixel data and black gray level data. The gamma compensation voltage is output from a voltage dividing circuit that divides a gamma reference voltage GMA to generate a voltage for each gray level, and is input to the DAC. The data voltage Vdata may be supplied to the data lines DL of the display panel 100 through the demultiplexer 112.

The demultiplexer 112 time-divisions and distributes the data voltage Vdata output through one channel of the data driving unit 110 to the plurality of data lines DL. In virtue of the demultiplexer 112, the number of channels of the data driving unit 110 may be decreased.

The gate driving unit 120 may sequentially scan the pixel lines by sequentially applying a gate signal to the pixel lines of the display panel 100. The pixels of the pixel lines charge the data voltage Vdata synchronized with the gate signal when the gate signal is applied.

The gate driving unit 120 may be implemented as a Gate in panel (GIP) circuit formed directly on a bezel region BZ on the display panel 100 together with a TFT array of a pixel array. The gate driving unit 120 outputs a gate signal to the gate lines GL under the control of the timing controller 130. The gate driving unit 120 may shift the gate signal using a shift register and sequentially supply the shifted signal to the gate lines GL. The gate signal swings between a gate-off voltage VGH/VEH and a gate-on voltage VGL/VEL. The gate signal includes a scan signal and a light emitting control signal (hereinafter, referred to as "EM signal") for controlling light emitting times of the pixels. The gate lines may be divided into scan lines to which a scan signal is applied and EM lines (or light emitting control lines) to which an EM signal is applied.

The gate driving unit 120 may be disposed on each of the left and right bezels of the display panel 100 to supply a gate signal to the gate lines GL in a double feeding method. In the double feeding method, the gate driving units 120 on both sides are synchronized so that the gate signals may be simultaneously applied at both ends of one gate line. In another embodiment, the gate driving unit 120 may be disposed on one of the left and right bezels of the display panel 100 to supply the gate signal to the gate lines GL in a single feeding method.

The gate driving unit 120 may include a first gate driving unit 121 and a second gate driving unit 122. The first gate driving unit 121 outputs a pulse of the scan signal and shifts the pulse of the scan signal according to a shift clock. The second gate driving unit 122 outputs the pulse of the EM signal and shifts the pulse of the EM signal according to the shift clock. In the case of a model without a bezel, at least some of the switch elements constituting the first and second gate driving units 121 and 122 may be separately disposed in the pixel array.

The timing controller 130 receives pixel data of an input image and a timing signal synchronized with the pixel data from the host system. The timing signal includes a vertical synchronization signal Vsync, a horizontal synchronization signal Hsync, a clock CLK, a data enable signal DE and the like. One period of the vertical synchronization signal Vsync is one-frame period. One period of the horizontal synchronization signal Hsync and the data enable signal DE is one-horizontal period 1H. The pulse of the data enable signal DE is synchronized with one-line data to be written to the pixels of one-pixel line. Since the frame period and the horizontal period may be known by counting the data enable signal DE, the vertical synchronization signal Vsync and the horizontal synchronization signal Hsync may be omitted.

The host system may be a main circuit board of a Television (TV) system, a set-top box, a navigation system, a personal computer (PC), a vehicle system, a home theater system, a mobile device, or a wearable device. In the mobile device or the wearable device, the timing controller 130, the data driving unit 110, and the power supply unit 150 may be integrated into one drive integrated circuit D-IC as shown in FIG. 2. The host system may respond to coordinate data of a touch input inputted from the touch sensor driving unit and execute an application or process data corresponding to the touch input. In FIG. 2, the reference numeral 200 denotes a host system. In a mobile device, the host system may be implemented as an application processor (AP).

The timing controller 130 may multiply the input frame frequency by i times and control the operation timing of the display panel drivers 110, 112, and 120 at a frame frequency of the input frame frequency×i Hz (i is a positive integer greater than 0). The input frame frequency is 60 Hz in the National Television Standards Committee (NTSC) system and 50 Hz in the Phase-Alternating Line (PAL) system. The timing controller 130 or the host system 200 may lower the frame frequency to a frequency between 1 Hz and 30 Hz in order to lower the refresh rate of pixels in the low speed driving mode.

The timing controller 130 generates a data timing control signal for controlling the operation timing of the data driving unit 110, a MUX signal for controlling the operation timing of the demultiplexer 112, and a gate timing control signal for controlling the operation timing of the gate driving unit 120, based on the timing signals Vsync, Hsync, and DE received from the host system. The gate timing control signal may include a start pulse, a shift clock, or the like. A voltage level of the gate timing control signal output from the timing controller 130 may be converted into a gate-off voltage VGH/VEH and a gate-on voltage VGL/VEL through a level shifter (not shown) to be supplied to the gate driving unit 120. The level shifter may convert a low level voltage of the gate timing control signal into the gate-on voltage VGL, and a high level voltage of the gate timing control signal into the gate-off voltage VGH.

When the active pixel region APA is shifted, the timing controller 130 gradually changes the gray level value of the pixel data so that the gray level of the pixels is slowly and little by little changed to the target gray level of the pixels and thus the movement of the image on the screen is not visually recognized by the user. The timing controller 130 may selectively modulate only pixel data to be written to some pixels when the active pixel region APA is shifted. For example, when the active pixel region APA is shifted, the timing controller 130 may modulate only pixel data to be written in the active pixel AP and the dummy pixel DP existing at the boundary between the active pixel region APA and the dummy pixel region DPA.

The timing controller 130 determines the complexity of the data by analyzing pixel data of an input image inputted from the host system. The complexity of the data may be determined based on the gray level distribution of the input image. For example, the timing controller 130 may determine that the complexity of the input image is high if there is a large difference in gray level from 1 frame data of the input image through a histogram analysis. In addition, the timing controller 130 may determine that the complexity of the input image is high as the number of edges between objects in the input image increases.

The timing controller 130 may include a look-up table in which a target gray level and a shift period of pixel data is set. Herein, the target gray level is an input gray level value of pixel data. According to the present disclosure, the target gray level of the pixel data may be subdivided as the active pixel region APA is shifted, such that the target gray level of pixel data written in the dummy pixel P may be increased from the black gray level to the target gray level. When the active pixel region APA is shifted, the dummy pixel P may charge a data voltage of pixel data whose gray level value gradually changes to a target gray level to be changed into the active pixel. The timing controller 130 gradually decreases pixel data to be written to an active pixel that changes to a dummy pixel in a direction opposite to the shift direction of the active pixel region APA up to a black gray level, which is a target gray level.

The timing controller 130 may move pixel data of the input image in units of pixels to prevent afterimages and deterioration of the pixels to allow the image reproduced in the active pixel region APA to be shifted. The timing controller 130 may gradually change a gray level value of pixel data written to a dummy pixel such that the luminance of the dummy pixel may be gradually increased or decreased to a target gray level when the active pixel region APA is shifted. Therefore, the user does not recognize that the active pixel region APA is shifted when the image is moved.

The power supply unit 150 may include a charge pump, a regulator, a buck converter, a boost converter, and the like. The power supply unit 150 generates power for driving the display panel driver and the display panel 100 by adjusting the DC input voltage from the host system. The power supply unit 150 may output DC voltages such as a gamma reference voltage GMA, the gate-off voltage VGH/VEH, the gate-on voltage VGL/VEL, a pixel driving voltage VDD, a low-potential power supply voltage VSS, an initialization voltage Vini, and a reference voltage Vref. The gamma reference voltage GMA is supplied to the data driving unit 110. The gate-off voltage VGH/VEH and the gate-on voltage VGL/VEL are supplied to the gate driving unit 120. The pixel driving voltage VDD, the low-potential power supply voltage VSS, the initialization voltage Vini, and the reference voltage Vref are commonly supplied to pixel circuits through power lines omitted in FIG. 2. The pixel driving voltage VDD is set to a voltage higher than the low-potential power supply voltage VSS, the initialization voltage Vini, and the reference voltage Vref.

Figure 3:
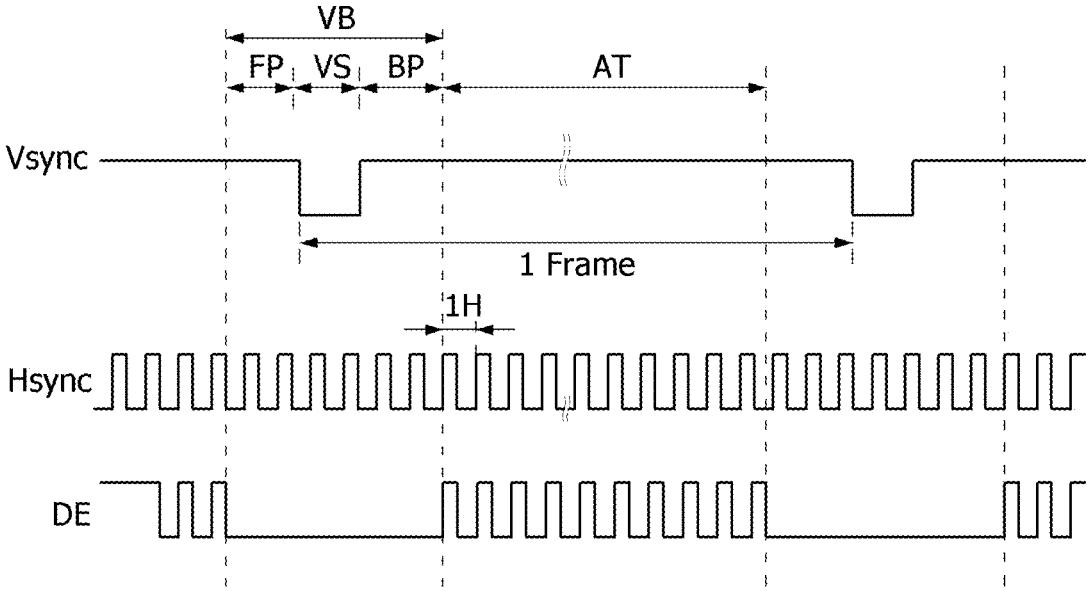
FIG. 3 is a diagram showing 1 frame period.

FIG. 3 is a diagram showing one frame period. In FIG. 3, a vertical synchronization signal Vsync, a horizontal synchronization signal Vsync, and a data enable signal DE are timing signals synchronized with pixel data of an input image.

Referring to FIG. 3, one frame period (one Frame) is divided into an active interval AT in which pixel data of an input image is written to pixels, and a vertical blank period VB without the pixel data.

The vertical blank period VB is a blank period in which the pixel data is not received in the timing controller 130 between the active interval AT of the N−1th frame period and the active interval AT of the Nth frame period (N is a natural number). The vertical blank period VB includes a vertical sync time VS, a vertical front porch FP, and a vertical back porch BP.

The vertical synchronization signal Vsync defines one frame period. One pulse period of the horizontal synchronization signal Hsync and the data enable signal DE is one horizontal period 1H. The data enable signal DE defines an effective data section including pixel data to be written to the pixels. The pulse of the data enable signal DE is synchronized with pixel data to be written to the pixels of the display panel 100.

Figure 4:
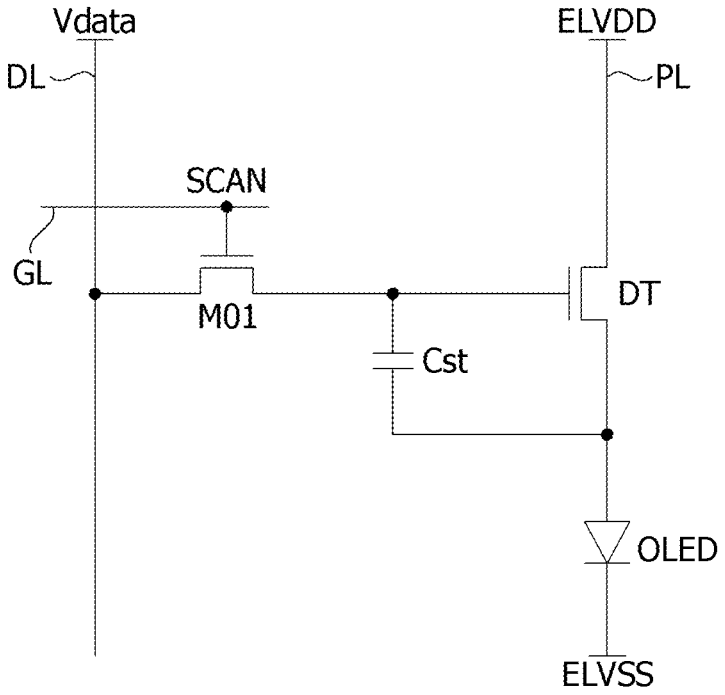
FIGS. 4 to 6 are circuit diagrams showing various pixel circuits applicable to a display device of a present disclosure.
Figure 5:
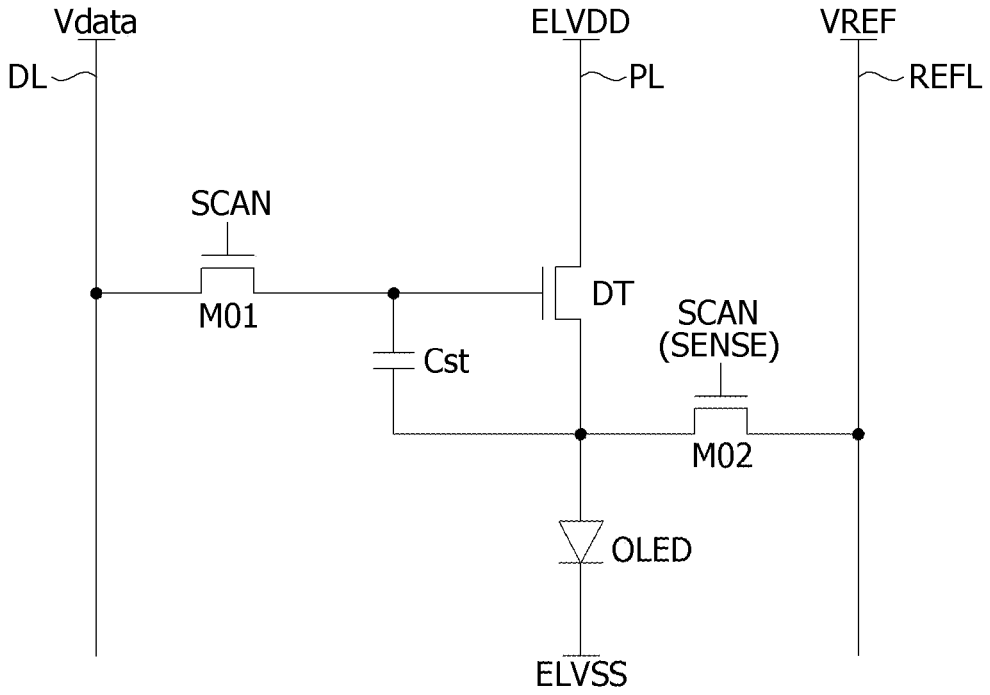
Figure 6:
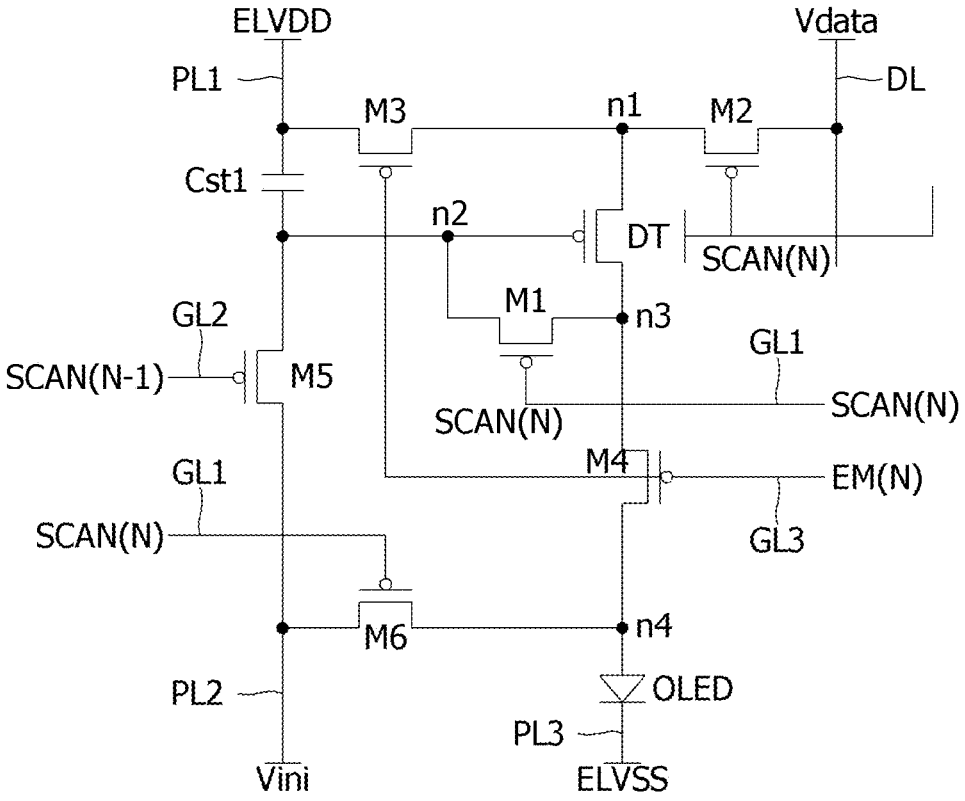

FIGS. 4 to 6 are circuit diagrams showing various pixel circuits applicable to a display device of a present disclosure.

Referring to FIG. 4, the pixel circuit includes a light emitting element OLED, a driving element DT that supplies current to the light emitting element OLED, a switch element M01 connecting the data line DL in response to a scan pulse SCAN, and a capacitor Cst connected to the gate of the driving element DT. The driving element DT and the switch element M01 may be implemented with n-channel transistors.

The pixel driving voltage ELVDD is applied to the first electrode of the driving element DT through the power supply line PL. The device DT drives the light emitting device OLED by supplying current to the light emitting device OLED according to the gate-source voltage Vgs. The light emitting element OLED is turned on and emits light when the forward voltage between the anode electrode and the cathode electrode is greater than or equal to a threshold voltage. The capacitor Cst is connected between the gate electrode and the source electrode of the driving element DT to maintain the gate-source voltage Vgs of the driving element DT.

FIG. 5 is an example of a pixel circuit connected to an external compensation circuit.

Referring to FIG. 5, the pixel circuit further includes a second switch element M02 connected between a reference voltage line REFL and the second electrode (or source) of the driving element DT. In this pixel circuit, the driving element DT and the switch elements M01 and MO2 may be implemented with n-channel transistors.

The second switch element M02 applies the reference voltage Vref in response to the scan pulse SCAN or a separate sensing pulse SENSE. The reference voltage VREF is applied to the pixel circuit through the reference voltage line REFL.

In a sensing mode, the current flowing through the channel of the driving element DT or the current flowing through the driving element DT is sensed through the reference line REFL. The current flowing through the reference line REFL is converted into a voltage through an integrator and converted into digital data through an analog-to-digital converter ADC. This digital data includes threshold voltage and/or mobility information of the driving element DT. The sensing data output from the ADC is transmitted to a data calculating unit of the timing controller 130. The data calculating unit may select a compensation value according to the sensing data input from the ADC and add or multiply the compensation value to the pixel data to modulate the pixel data. The pixel data modulated by the data calculating unit is transmitted to a data driving unit 110 to be applied to the pixels with a threshold voltage of the driving element DT and/or a data voltage in which mobility is compensated.

Figure 7:
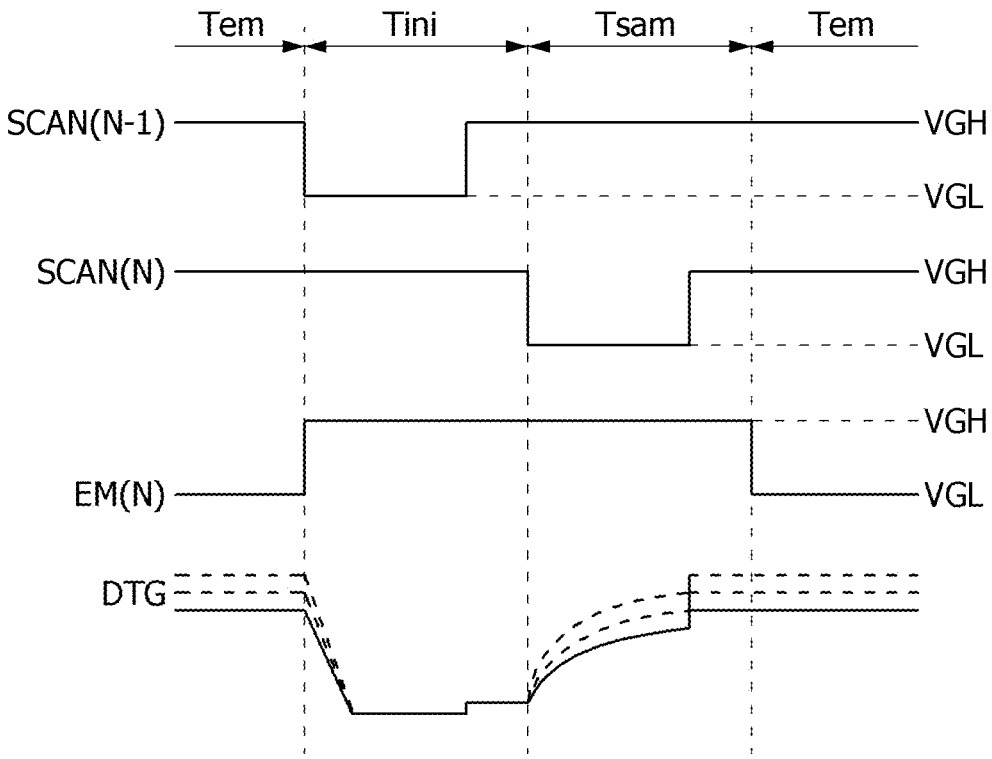
FIG. 7 is a waveform diagram showing a method of driving the pixel circuit shown in FIG. 6.

FIG. 6 is a circuit diagram showing an example of a pixel circuit to which an internal compensation circuit is applied. FIG. 7 is a waveform diagram showing a method of driving the pixel circuit shown in FIG. 6.

Referring to FIGS. 6 and 7, the pixel circuit includes a light emitting element OLED, a driving element DT for supplying a current to the light emitting element OLED, and a switch circuit for switching a voltage applied to the light emitting element OLED and the driving element DT.

The switch circuit is connected to the pixel driving voltage ELVDD, the low-potential power supply voltage ELVSS, the power supply lines PL1, PL2, and PL3 to which the initialization voltage Vini is applied, the data line DL, and the gate lines GL1, GL2 and GL3, such that the voltages applied to the light emitting element OLED and the driving element DT are switched in response to the scan pulse SCAN(N−1) and SCAN(N) and the EM pulse EM(N).

The switch circuit includes an internal compensation circuit that samples the threshold voltage Vth of the driving element DT by using the plurality of switch elements M1 to M6, stores it in the capacitor Cst1, and compensates for the gate voltage of the driving element by the threshold voltage Vth of the driving element DT. Each of the driving element DT and the switch elements M1 to M6 may be implemented as a p-channel TFT.

The driving period of the pixel circuit may be divided into an initialization period Tini, a sampling period Tsam, and a light emitting period Tem as shown in FIG. 7.

The Nth scan pulse SCAN(N) is generated as the gate-on voltage VGL during the sampling period Tsam and applied to the first gate line GL1. The N−1th scan pulse SCAN(N−1) is generated as the gate-on voltage VGL during the initialization period Tini prior to the sampling period, and is applied to the second gate line GL2. The EM pulse EM(N) is generated as the gate-off voltage VGH during the initialization period Tini and the sampling period Tsam and applied to the third gate line GL3.

During the initialization period (Tini), the N−1th scan pulse SCAN(N−1) is generated as the gate-on voltage VGL, and each voltage of the Nth scan pulse SCAN(N) and the EM pulse EM(N)] is the gate-off voltage VGH. During the sampling period Tsam, the Nth scan pulse SCAN(N) is generated as a pulse of the gate-on voltage VGL, and each voltage of the N−1th scan pulse SCAN(N−1) and the EM pulse EM(N) is the gate-off voltage VGH. During at least a portion of the light emitting period Tem, the EM pulse EM(N) is generated as the gate-on voltage VGL, and each voltage of the N−1th scan pulse SCAN(N−1) and the Nth scan pulse SCAN(N) is generated as the gate-off voltage VGH.

During the initialization period Tini, the fifth switch element M5 is turned on according to the gate-on voltage VGL of the N−1th scan pulse SCAN(N−1) to initialize the pixel circuit. During the sampling period Tsam, the first and second switch elements M1 and M2 are turned on according to the gate-on voltage VGL of the N-th scan pulse SCAN (N), such that the data voltage Vdata compensated by the threshold voltage of the driving element is stored in the capacitor Cst1. At the same time, the sixth switch element M6 is turned on during the sampling period Tsam to lower the voltage of the fourth node n4 to the reference voltage Vref. Accordingly, the light emission of the light emitting element OLED is suppressed.

During the light emitting period Tem, the third and fourth switch elements M1 and M2 are turned on to emit light. During the light emitting period (Tem), in order to accurately express the luminance of the low gray level, the voltage level of the EM pulse EM(N) may be inverted at a predetermined (or selected) duty ratio between the gate-on low voltage VGL and the gate-off voltage VGH. In this case, the third and fourth switch elements M3 and M4 may repeat on/off according to the duty ratio of the EM pulse EM(N) during the light emitting period Tem.

The anode electrode of the light emitting element OLED is connected to the fourth node n4 between the fourth and sixth switch elements M4 and M6. The fourth node n4 is connected to the anode electrode of the light emitting element OLED, the second electrode of the fourth switch element M4, and the second electrode of the sixth switch element M6. The cathode electrode of the light emitting element OLED is connected to the VSS line PL3 to which the low-potential power supply voltage ELVSS is applied. The light emitting element OLED emits light with a current Ids flowing according to the gate-source voltage Vgs of the driving element DT. The current path of the light emitting element OLED is switched by the third and fourth switch elements M3 and M4.

The capacitor Cst1 is connected between the VDD line PL1 and the first node n1. The data voltage Vdata compensated by the threshold voltage Vth of the driving element DT is charged in the capacitor Cst1. Since the data voltage Vdata in each of the sub-pixels is compensated by the threshold voltage Vth of the driving element DT, a characteristic deviation of the driving element DT is compensated for in the sub-pixels.

The first switch element M1 is turned on in response to the gate-on voltage VGL of the Nth scan pulse SCAN(N) to connect the second node n2 and the third node n3. The second node n2 is connected to the gate electrode of the driving element DT, the first electrode of the capacitor Cst1, and the first electrode of the first switch element M1. The third node n3 is connected to the second electrode of the driving element DT, the second electrode of the first switch element M1, and the first electrode of the fourth switch element M4. The gate electrode of the first switch element M1 is connected to the first gate line GL1 to receive the Nth scan pulse SCAN(N). The first electrode of the first switch element M1 is connected to the second node n2, and the second electrode of the first switch element M1 is connected to the third node n3.

The first switch element M1 is turned on for one very short horizontal period 1H in which the Nth scan pulse SCAN(N) is generated as the gate-on voltage (VGL) during one frame period, so that a leakage current may be generated in the off state. In order to suppress the leakage current of the first switch element M1, the first switch element M1 may be implemented as transistors having a dual gate structure in which two transistors are connected in series.

The second switch element M2 is turned on in response to the gate-on voltage VGL of the Nth scan pulse SCAN(N) to supply the data voltage Vdata to the first node n1. The gate electrode of the second switch element M2 is connected to the first gate line GL1 to receive the Nth scan pulse SCAN(N). The first electrode of the second switch element M2 is connected to the first node n1. The second electrode of the second switch element M2 is connected to the data line DL to which the data voltage Vdata is applied. The first node n1 is connected to the first electrode of the second switch element M2, the second electrode of the third switch element M3, and the first electrode of the driving element DT.

The third switch element M3 is turned on in response to the gate-on voltage VGL of the EM pulse EM(N) to connect the VDD line PL1 to the first node n1. The gate electrode of the third switch element M3 is connected to the third gate line GL3 to receive an EM pulse EM(N). The first electrode of the third switch element M3 is connected to the VDD line PL1. The second electrode of the third switch element M3 is connected to the first node n1.

The fourth switch element M4 is turned on in response to the gate-on voltage VGL of the EM pulse EM(N) to connect the third node n3 to the anode electrode of the light emitting element OLED. The gate electrode of the fourth switch element M4 is connected to the third gate line GL3 to receive the EM pulse EM(N). The first electrode of the fourth switch element M4 is connected to the third node n3, and the second electrode is connected to the fourth node n4.

The fifth switch element M5 is turned on in response to the gate-on voltage VGL of the N−1th scan pulse SCAN (N−1) to connect the second node n2 to the Vini line PL2. The gate electrode of the fifth switch element M5 is connected to the second gate line GL2 to receive the N−1th scan pulse SCAN(N−1). The first electrode of the fifth switch element M5 is connected to the second node n2, and the second electrode is connected to the Vini line PL2. In order to suppress the leakage current of the fifth switch element M5, the fifth switch element M5 may be implemented as transistors having a dual gate structure in which two transistors are connected in series.

The sixth switch element M6 is turned on in response to the gate-on voltage VGL of the Nth scan pulse SCAN(N) to connect the Vini line PL2 to the fourth node n4. The gate electrode of the sixth switch element M6 is connected to the first gate line GL1 to receive the Nth scan pulse SCAN(N). The first electrode of the sixth switch element M6 is connected to the Vini line PL2, and the second electrode is connected to the fourth node n4.

In another embodiment, the gate electrodes of the fifth and sixth switch elements M5 and M6 may be commonly connected to the second gate line GL2 to which the N−1th scan pulse SCAN(N−1) is applied. In this case, the fifth and sixth switch elements M5 and M6 may be turned on at the same time in response to the N−1th scan pulse SCAN(N−1).

The driving element DT drives the light emitting element OLED by controlling a current flowing through the light emitting element OLED according to the gate-source voltage Vgs. The driving element DT includes a gate connected to the second node n2, a first electrode connected to the first node n1, and a second electrode connected to the third node n3.

During the initialization period Tini, the N−1th scan pulse SCAN(N−1) is generated as the gate-on voltage VGL. The Nth scan pulse SCAN(N) and the EM pulse EM(N) maintain the gate-off voltage VGH during the initialization period Tini. Thus, the fifth switch element M5 is turned on during the initialization period Tini, so that the second and fourth nodes n2 and n4 are initialized to Vini. A hold period may be set between the initialization period Tini and the sampling period Tsam. In the hold period, the scan pulse SCAN(N−1), SCAN(N) and the EM pulse EM(N) are the gate-off voltage VGH.

During the sampling period Tsam, the Nth scan pulse SCAN(N) is generated as the gate-on voltage VGL. The pulse of the Nth scan pulse SCAN(N) is synchronized with the data voltage Vdata of the Nth pixel line. The N−1th scan pulse SCAN(N−1) and the EM pulse EM(N) maintain the gate-off voltage VGH during the sampling period Tsam. Accordingly, the first and second switch elements M1 and M2 are turned on during the sampling period Tsam.

During the sampling period Tsam, the gate voltage DTG of the driving element DT is increased by the current flowing through the first and second switch elements M1 and M2. When the driving element DT is turned off, the gate node voltage DTG is Vdata In this case, the voltage of the first node n is also Vdata During the sampling period Tsam, the gate-source voltage Vgs of the driving element DT is $|Vgs|=Vdata-(Vdata-|Vth|)=|Vth|$.

During the light emitting period Tem, the EM pulse EM(N) may be generated as the gate-on voltage VGL. During the light emitting period Tem, the voltage of the EM pulse EM(N) may be inverted to a predetermined (or selected) duty ratio. Accordingly, the EM pulse EM(N) may be generated as the gate-on voltage VGL during at least a portion of the light emitting period Temp.

When the EM pulse EM(N) is the gate-on voltage VGL, the current flows between the ELVDD and the light emitting element OLED, so that the light emitting element OLED may emit light. During the light emitting period Tem, the N−1th and Nth scan pulses SCAN(N−1) and SCAN(N)] maintain the gate-off voltage VGH. During the light emitting period Tem, the third and fourth switch elements M3 and M4 are turned on according to the gate-on voltage VGL of the EM pulse EM. When the EM pulse EM(N) is the gate-on voltage VGL, the third and fourth switch elements M3 and M4 are turned on, so that the current flows through the light emitting element OLED. In this case, Vgs of the driving element DT is |Vgs|=ELVDD−(Vdata−|Vth|), and the current flowing through the light emitting element OLED is K(ELVDD−Vdata)2. K is a constant value determined by the charge mobility, parasitic capacitance, and channel capacity of the driving element DT.

Figure 8:
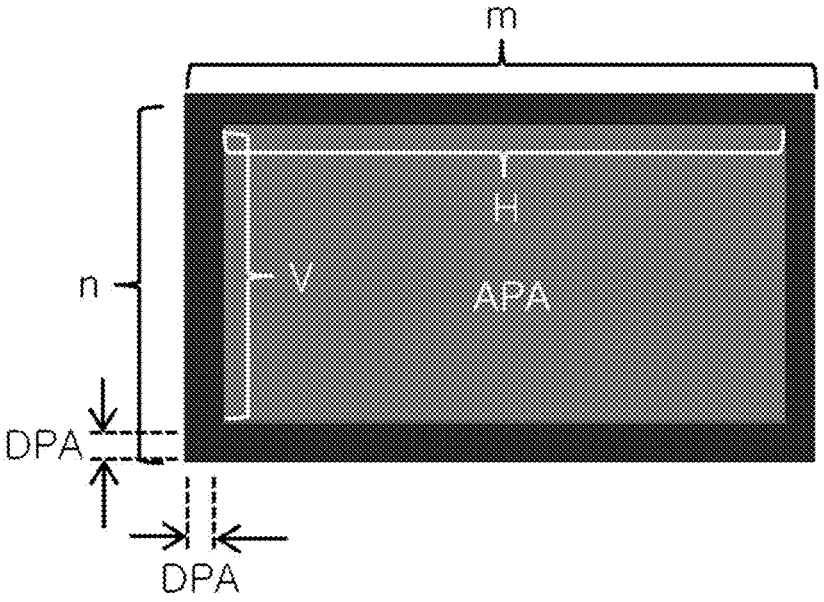
FIG. 8 is a diagram showing resolutions of an active pixel region and a dummy pixel region of a pixel array.

FIG. 8 is a diagram showing resolutions of an active pixel region APA and a dummy pixel region DPA of the pixel array AA.

Referring to FIG. 8, the pixel array AA of the display panel 100 has a resolution (m*n) greater than that of an input image. The input image is scaled to the resolution (H*V) of the active pixel region APA by the host system 200 or the timing controller 130 so that the pixel data matches the pixels of the active pixel region APA, and is displayed on the pixels of the active pixel region APA. For example, the resolution of the input image may be Ultra HD(UHD) resolution, that is, 3840*2160. In this case, the physical resolution of the pixel array AA may be implemented as 3872*2192 in order to secure the dummy pixel region DPA.

The data driving unit 110 and the gate driving unit 120 may have the number of channels suitable for the physical resolution of the pixel array AA. The timing controller 130 adds dummy data to be written in the dummy pixel to the pixel data of the input image to transmit data corresponding to the physical resolution of the pixel array AA to the data driving unit 110, and controls the output of the gate driving unit 120 so as to be synchronized with the data voltage output from the data driving unit 110. The data driving unit 110 outputs a data voltage equal to the number of horizontal resolutions from the physical resolution of the pixel array AA during one horizontal period. The gate driving unit 120 sequentially outputs gate signals as many as the number of vertical resolutions from the physical resolution of the pixel array AA during one vertical period. Accordingly, data may be written to all pixels of the pixel array AA having a physical resolution greater than that of the input image. The pixel data of the input image is written to the active pixel, and the dummy data is written to the dummy pixel. When the active pixel region APA is shifted, the gray level value of the pixel data may gradually change during the pixel shift period to be changed to a black gray level value under the control of the timing controller 130. On the other hand, the gray level value of the dummy data may change gradually during the pixel shift period to be changed to the target gray level of the pixel data.

The dummy pixel region DPA includes pixels at an upper boundary, pixels at a lower boundary, pixels at a left boundary, and pixels at a right boundary of the pixel array AA. Each of the left and right dummy pixel regions DPA of the pixel array AA includes m−(H/2) pixels. Each of the upper and lower dummy pixel regions DPA of the pixel array AA includes n−(V/2) pixels. For example, the physical resolution of the pixel array AA may be 3872*2192, and the resolution of the active pixel region APA may be 3840*2160 equal to the resolution of the input image. In this example, 16 dummy pixels are added in the width direction of each of the upper and lower dummy pixel regions DPA, and likewise, 16 dummy pixels are added in the width direction of each of the left and right dummy pixel regions DPA.

Figure 9:
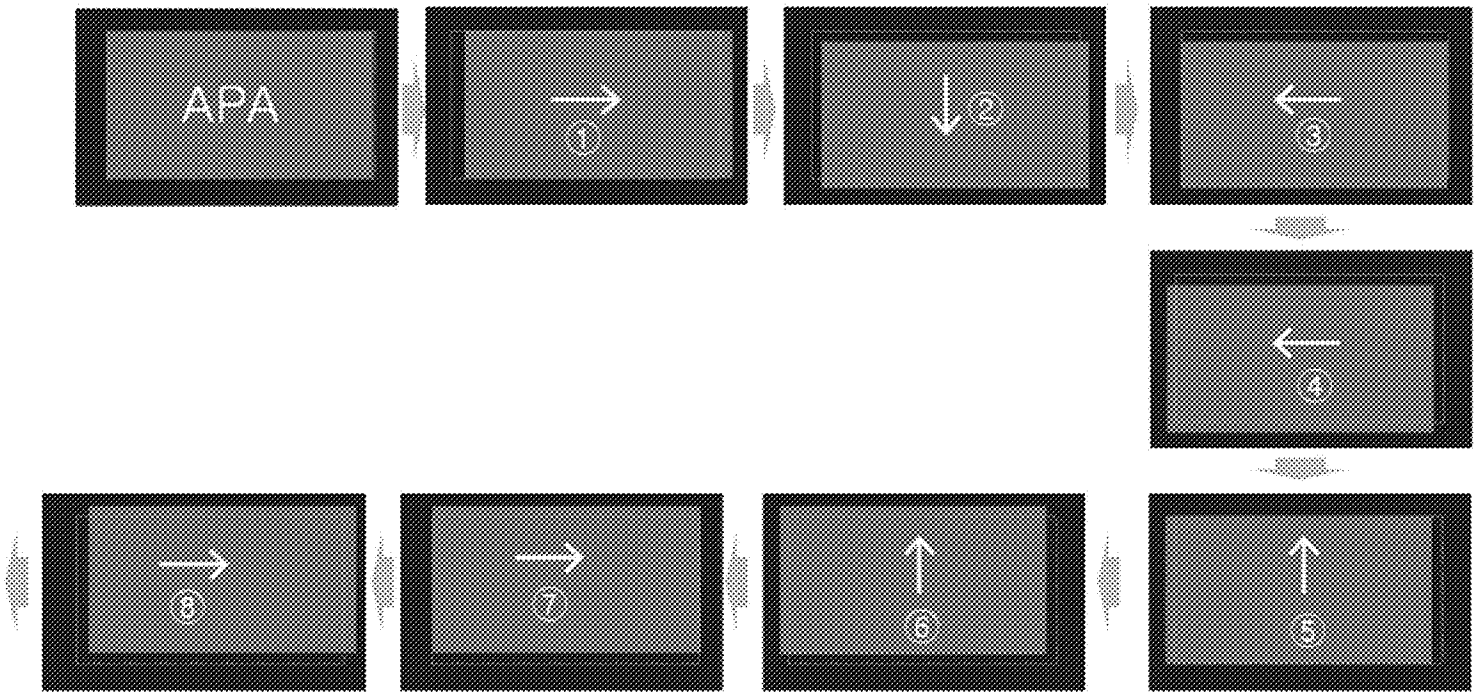
FIGS. 9 and 10 are diagrams illustrating an example in which an active pixel region is shifted.
Figure 10:
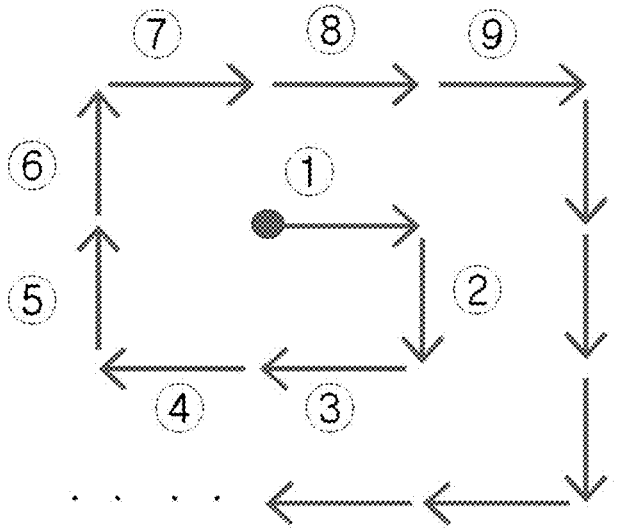
Figure 11:
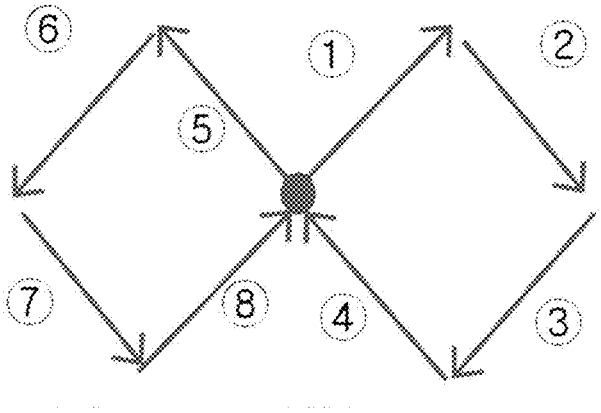
FIG. 11 is a diagram illustrating another example in which an active pixel region is shifted.

The timing controller 130 shifts the pixel data in pixel units according to a preset (or selected) pixel shift amount during a predetermined (or selected) period of time within a range in which the active pixel region APA does not exceed the dummy pixel region (DPA), such that the active pixel region DPA in which the input image is displayed is shifted. For example, as illustrated in FIGS. 9 and 10, the active pixel region APA may be shifted in a spiral shape by 1 pixel for each frame period. In the same manner as in the example illustrated in FIG. 10, the active pixel region APA may be shifted by 1 pixel for each frame period. In FIGS. 9 to 11, ① to ② and arrows indicate the pixel shift direction of the active pixel region APA during the 9 frame period.

When the active pixel region APA is shifted, the pixels at the boundary between the active pixel region APA and the dummy pixel region DPA may be gradually changed. The active pixel region APA may rotate in a preset (or selected) pixel shift direction and return to its original position as shown in FIGS. 9 to 11. One pixel shift period may be a period indicated by a single arrow in FIGS. 9 to 11, and may be a period until return to the original position while the pixel shift direction is changed.

Figure 12:
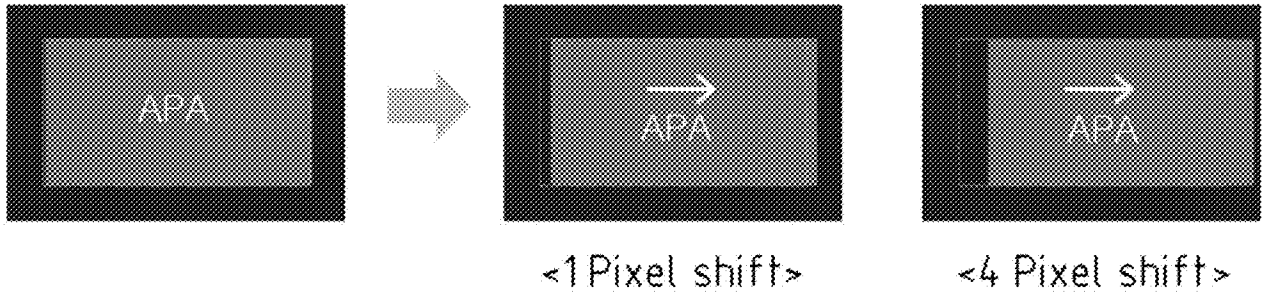
FIG. 12 is a diagram illustrating examples in which a shift amount is different when the active pixel region is shifted.

FIG. 12 is a diagram illustrating examples in which the shift amount is different when the active pixel region APA is shifted. The active pixel region APA may be shifted vertically and horizontally by a length of 1 to 8 pixels. The greater the shift amount of the active pixel region APA, the greater the probability that the user perceives the movement of the active pixel region APA on the screen. In the example of FIG. 12, there is a higher probability that the movement of the active pixel region APA is perceived when the active pixel region APA is shifted by 4 pixels than when the active pixel region APA is shifted by 1 pixel to the right.

Figure 13:
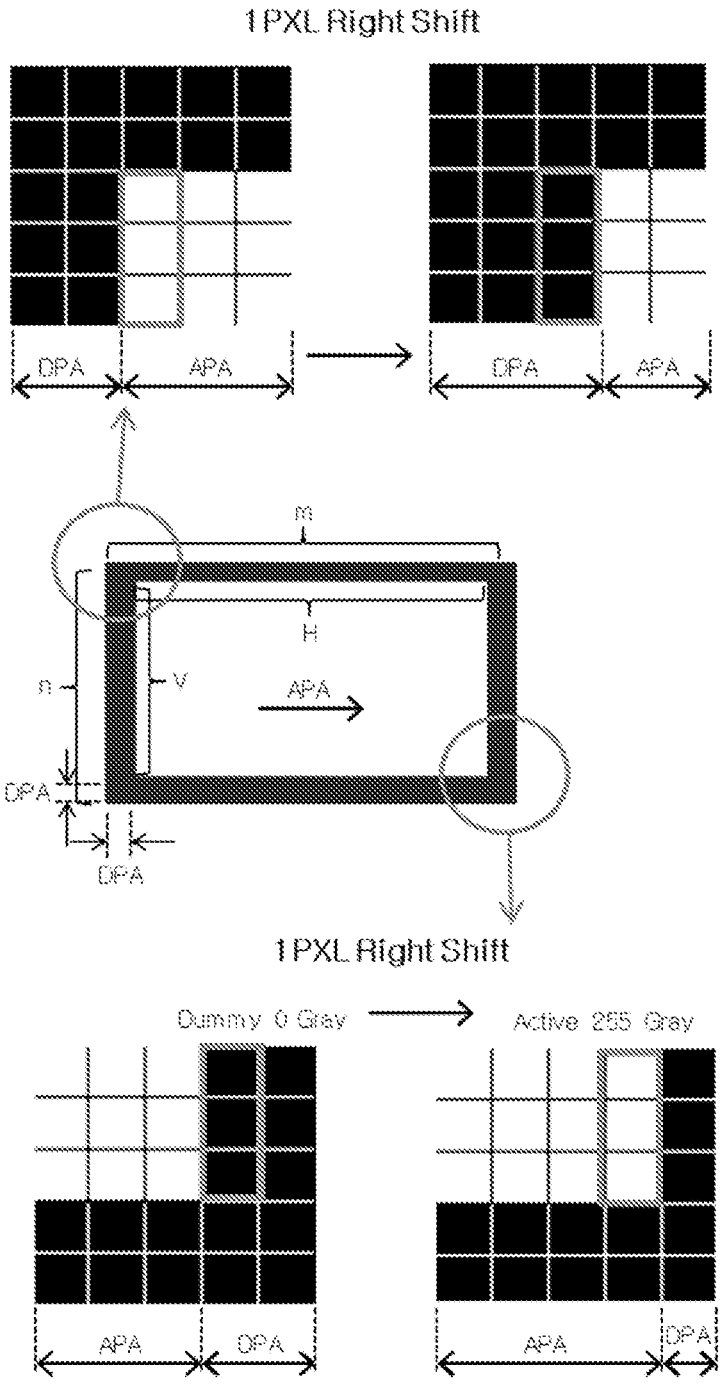
FIG. 13 is a diagram illustrating an example in which a gray level difference of pixel data is large between an active pixel region and a dummy pixel region.

FIG. 13 is a diagram illustrating an example in which a gray level difference of pixel data is large between an active pixel region APA and a dummy pixel region DPA. The pixels of the dummy pixel region DPA appear black because the data of the black gray level is written and the light emitting element OLED is turned off. The pixels of the active pixel region APA are written with pixel data to emit light with a brightness corresponding to a gray level value of the pixel data. The higher the gray level of pixel data written to the pixels of the active pixel region APA adjacent to the dummy pixel region DPA, the higher the brightness of the pixel. In this case, since the brightness difference between pixels at the boundary between the active pixel region APA and the dummy pixel region DPA is high, even if the shift amount of the active pixel region APA is small, the probability that the movement of the active pixel region APA is perceived is high. In the example of FIG. 13, the pixels of the active pixel region APA emit light with a maximum gray level value (or white gray level value) of 255 based on 8-bit data, and the active pixel region APA is shifted by 1 pixel to the right. In this case, since the difference in luminance between the pixels at the left and right boundaries of the active pixel region APA and the dummy pixels is large, the user may perceive the movement of the active pixel region APA.

Figure 14:
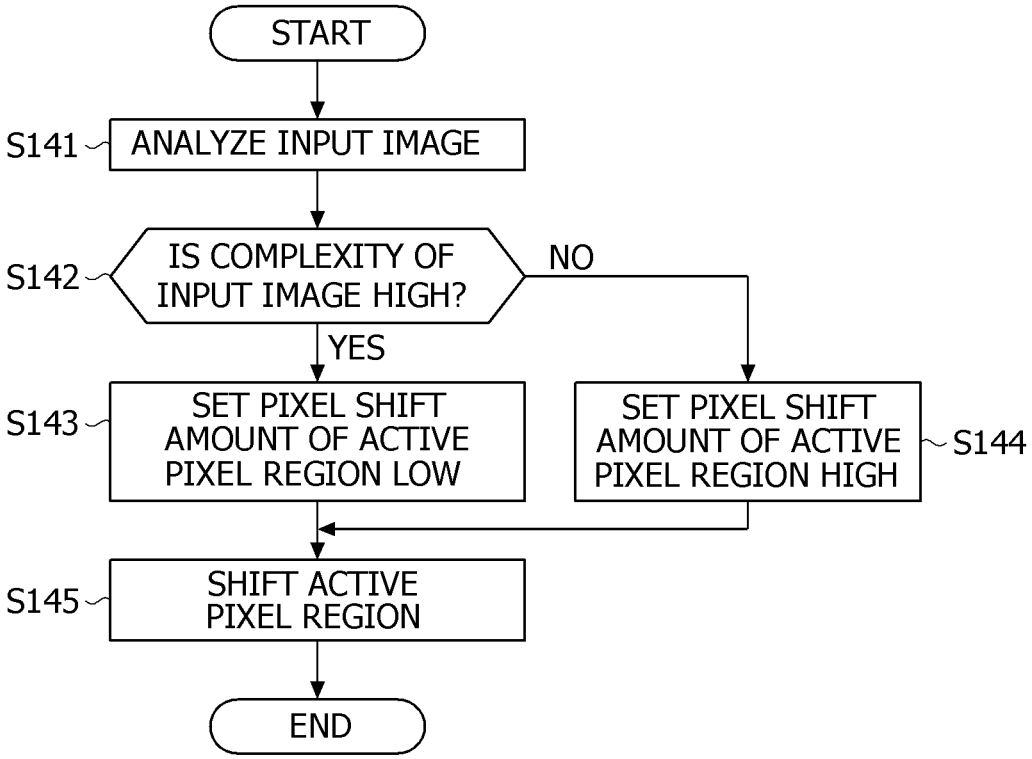
FIG. 14 is a flowchart illustrating a method of controlling a shift amount of an active pixel region based on a result of analyzing a complexity of an input image in an image processing method according to an embodiment of the present disclosure.

FIG. 14 is a flowchart illustrating a method of controlling a shift amount of an active pixel region based on a result of analyzing the complexity of an input image in an image processing method according to an embodiment of the present disclosure. This image processing method may be controlled by a timing controller 130.

Referring to FIG. 14, in the present disclosure, an input image may be analyzed and a pixel shift amount is varied according to the complexity of the input image.

Figure 15A:
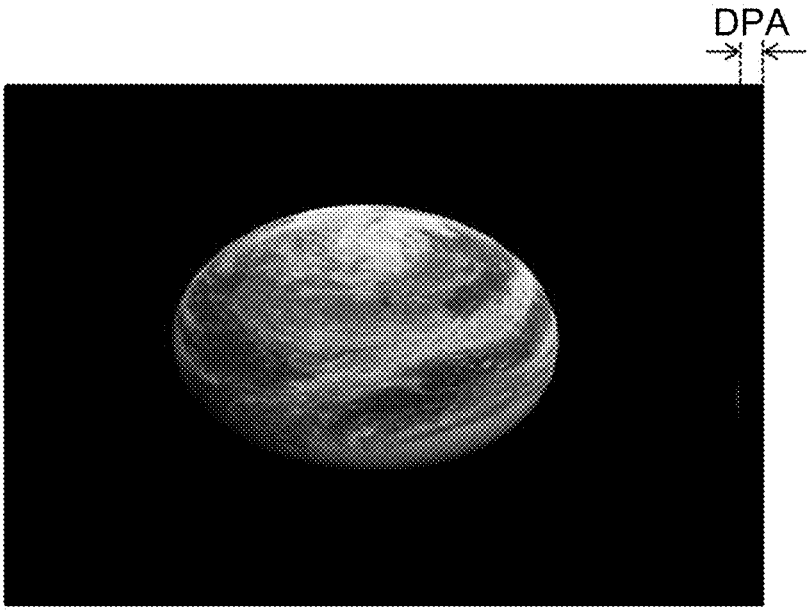
FIGS. 15A and 15B are diagrams illustrating examples in which a complexity of an input image is different.
Figure 15B:
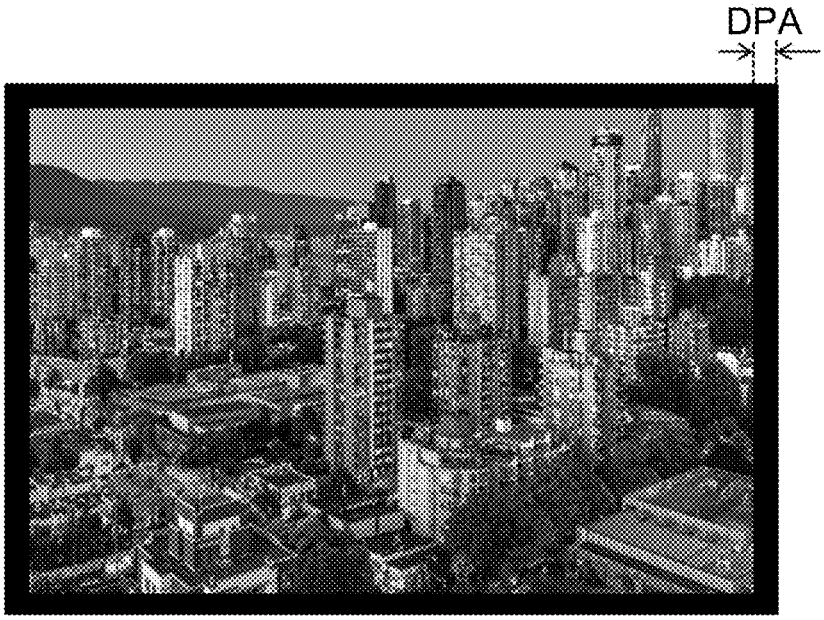

FIG. 15A shows an example of an image with low complexity of an input image. FIG. 15B shows an example of an image with high complexity of an input image. As shown in FIGS. 15A and 15B, as the complexity of the input image increases, the boundary between the active pixel region APA in which the input image is displayed and the dummy pixel region DPA are more visually recognized. Therefore, when an image with high complexity of the input image is rapidly shifted, the user perceives the movement of the image displayed in the active pixel region APA.

In the present disclosure, the pixel data of the input image is analyzed to determine the complexity of the image (S141). The complexity of the data may be determined based on the gray level distribution of the input image using a histogram analysis technique. In an image at a boundary close to the dummy pixel region DPA, the more data with a large difference in gray level are distributed or the more data of the high gray level is, and the more edges between objects in the image are, the higher the complexity of the image. On the other hand, as the difference in gray level is relatively small, or as data of the low gray level is greater than data of the high gray level and as edges between the objects are less, the complexity of the image is lower.

In the present disclosure, as the complexity of an input image, in particular, the complexity of pixel data to be written to pixels at the boundary of the active pixel region close to the dummy pixel region becomes high, the pixel shift amount is set to be low and the moving speed of the image with high complexity is lowered to be shifted (S142, S143, and S145). As a result, the user does not recognize the movement of the image when the image with high complexity is shifted as shown in FIG. 15B. For example, the image shown in FIG. 15B may be shifted by 1 pixel.

In the present disclosure, as the complexity of an input image, in particular, the complexity of pixel data to be written to pixels at the boundary of the active pixel region APA close to the dummy pixel region becomes low, the pixel shift amount is set to be high and the pixel shift amount is set to be high. Thus, an image having a low probability of recognizing the movement of the image may be shifted relatively quickly (S142, S144, and S145). For example, the image shown in FIG. 15A may be shifted by a maximum of 8 pixels.

Figure 16:
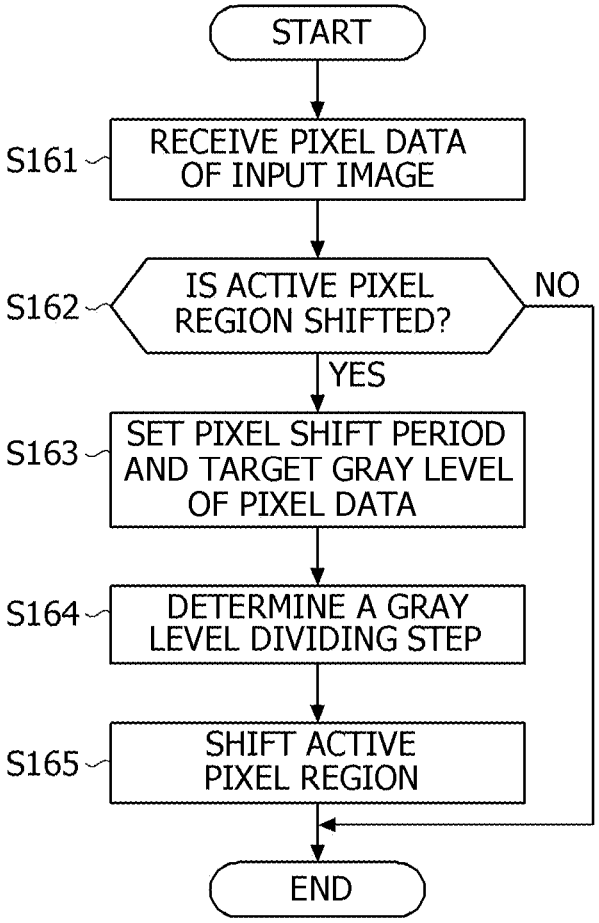
FIG. 16 is a flowchart illustrating a method of shifting an active pixel region by setting a pixel shift period and a target gray level in an image processing method according to an embodiment of the present disclosure.

FIG. 16 is a flowchart illustrating a method of shifting an active pixel region by setting a pixel shift period and a target gray level in an image processing method according to an embodiment of the present disclosure. This image processing method may be controlled by the timing controller 130.

Referring to FIG. 16, according to the present disclosure, when the timing controller 130 receives pixel data of an input image, it may determine a shift of the active pixel region APA (S161 and S162). When pixel data of a still image is input for more than a preset (or selected) reference time, the active pixel region APA may be shifted.

In another embodiment, when pixel data of an input image is received in the timing controller 130, the timing controller 130 may shift the active pixel region APA with a preset (or selected) time period regardless of whether or not the still image is present.

The timing controller 130 sets a pixel shift period and a target gray level of pixel data prior to the shift of the active pixel region APA (S163). The pixel shift period means a period until the gray level of the pixel data to be written to the pixel reaches the target gray level while the active pixel region APA is shifted along a preset (or selected) pixel shift direction as shown in FIGS. 9 to 11. The pixel shift period may be determined according to a time required by the customer, an application running on the host system, or an input image. For example, if the input image is a still image or has a low complexity, since the movement of the image is easily recognized, the pixel shift period is set to a long period, so that the active pixel region APA may be slowly shifted. On the other hand, in the case of a moving image with a lot of movement, since the probability of recognizing the movement of the image is low, the pixel shift period is set to a relatively short period, so that the active pixel region APA may be shifted relatively quickly. The pixel shift period may be set in units of frame periods.

The timing controller 130 determines a gray level dividing step according to the pixel shift period and the target gray level (S164). The gray level dividing step means the number of steps for subdividing a gray level change amount from a current gray level to a target gray level. The current gray level of the dummy pixel to be changed to an active pixel is a black gray level. The current gray level of the active pixel to be changed to a dummy pixel is a gray level of the pixel data. The target gray level of the dummy pixel to be changed to an active pixel is a gray level of the pixel data. The target gray level of the active pixel to be changed to a dummy pixel is a black gray level.

As the number of gray level dividing steps increases, the number of steps for subdividing the gray level difference between the current gray level and the target gray level increases, such that the change amount of the gray level decreases. As a result, even if the gray level difference between the active pixel and the adjacent dummy pixel is large, the gray level between them is gradually changed. Thus the probability of recognizing image movement may be decreased when the active pixel region APA is shifted.

The timing controller 130 divides the gray level of the pixel data of the input image and the data to be written to the dummy pixel by the gray level dividing step determined previously so that the active pixel region APA may be shifted, and gradually changes the gray level value of the pixel data. As a result, the active pixel region APA is gradually shifted in the pixel array AA by a gray level change amount divided by the gray level dividing step during the pixel shift period (S165). In this case, the active pixel region APA may be shifted according to the pixel shift amount determined based on the analysis result of the input image.

The timing controller 130 gradually increases or decreases the gray level of the shifted pixels by subdividing the gray level difference up to the target gray level as the pixel shift period increases and the gray level difference increases.

FIG. 17 is a diagram illustrating an example of a look-up table (LUT) in which a pixel shift period of an active region is set. The timing controller 130 may include the look-up table in which the pixel shift period is set according to a pixel shift time and a target gray level to prevent afterimages and pixel deterioration.

Referring to FIG. 17, the lookup table includes a target gray level setting region of an upper line, a pixel shift period setting region of one column, and a pixel shift period setting region in which a gray level dividing step is selected according to a target gray level and pixel shift period.

The timing controller 130 inputs data of a target gray level TGR and pixel shift period SHP for each pixel into the lookup table as a read address of a ROM memory. When the lookup table receives data of the target gray level TGR and pixel shift period SHP, a gray level dividing step STEP stored at the address indicated by the data is output.

For example, if the 1 pixel shift period SHP is 10 frame periods, the target gray level is not divided when the target gray level is in a low gray level section (0 to 63). In this case, when the active pixel region APA is shifted, the pixel data is modulated to the target gray level immediately during the one-pixel shift period. If the pixel shift period SHP is 10 frame periods, when the target gray level is in a middle gray level section (64 to 127), the difference in gray level up to the target gray level is divided into 2 steps to be divided equally. In this case, when the active pixel region APA is shifted, the pixel data is gradually modulated in 2 steps during one pixel shift period, and the gray level difference is subdivided to be modulated by the gray level change amount decreased in each step. In addition, if the pixel shift period SHP is 10 frame periods, when the target gray level is in a high gray level section (128 to 255), the target gray level is equally divided into 3 steps. In this case, when the active pixel region APA is shifted, the pixel data is gradually modulated in 3 steps during one pixel shift period, and modulated by the gray level change amount decreased in each step.

If the pixel shift period SHP is set within 11 to 20 frame periods, when the target gray level is in the low gray level section (0 to 63), the difference in gray level up to the target gray level is equally divided into 2 steps, and when the target gray level is in the middle gray level section (64 to 127), the difference in gray level up to the target gray level is equally divided into 3 steps. And when the target gray level is in the high gray level section (128 to 255), the difference in gray level up to the target gray level is equally divided into 4 steps.

If the pixel shift period SHP is set within 21 to 30 frame periods, when the target gray level is in the low gray level section (0 to 63), the difference in gray level up to the target gray level is equally divided into 3 steps, and when the target gray level is in the middle gray level section (64 to 127), the difference in gray level up to the target gray level is equally divided into 4 steps. And when the target gray level is in the high gray level section (128 to 255), the difference in gray level up to the target gray level is equally divided into 5 steps.

If the pixel shift period SHP is set within 31 to 40 frame periods, when the target gray level is in the low gray level section (0 to 63), the difference in gray level up to the target gray level is equally divided into 4 steps, and when the target gray level is in the middle gray level section (64 to 127), the difference in gray level up to the target gray level is equally divided into 5 steps. And when the target gray level is in the high gray level section (128 to 255), the difference in gray level up to the target gray level is equally divided into 6 steps.

The pixel shift period SHP may be varied according to the analysis result of the input image. For example, in a still image or an image with low complexity, the pixel shift period SHP may be set to a larger value than that of a moving image or an image with high complexity. As a result, as an image having a higher probability of recognizing movement of an image on the screen, the active pixel region APA is shifted more gradually, thereby lowering the probability of recognizing the image.

Accordingly, the timing controller 130 divides the gray level dividing step STEP output from the look-up table during one pixel shift period SHP to gradually change the gray level value of the pixel data up to the target gray level.

FIG. 18 is a diagram illustrating another example of a look-up table in which a pixel shift period of an active pixel region is set. In this look-up table, when the pixel shift amount increases, the number of gray level divisions in which the gray level of pixels is gradually changed is set to be larger in the pixel shift period SHP equal to the above-described 1 pixel shift amount and the target gray level TGR.

Referring to FIG. 18, the timing controller 130 inputs data of the target gray level TGR and pixel shift period SHP as a read address of a ROM memory into a look-up table for each pixel. When the look-up table receives data of the target gray level TGR and pixel shift period SHP, it outputs the gray level dividing step STEP stored at the address indicated by the data.

For example, if the 1 pixel shift period SHP is 10 frame periods, when the target gray level is in the low gray level section (0 to 63), the gray level values of the pixels are gradually changed to 2 steps to reach the target gray level. If the pixel shift period SHP is 10 frame periods, when the target gray level is the middle gray level section (64 to 127), the gray level difference to the target gray level is divided into 4 steps, and the gray level values of the pixels are gradually changed to 4 steps to reach the target gray level. If the pixel shift period SHP is in 10 frame periods, when the target gray level is in the high gray level section (128 to 255), the target gray level is divided into 6 steps, and the gray level values of the pixels gradually are changed into 4 steps to reach the target gray level. Accordingly, when the active pixel region APA is shifted, the target gray levels of the active pixel AP and the dummy pixel DP existing at the boundary between the active pixel region APA and the dummy pixel region DPA are divided by the number of steps set in the look-up table, and the pixel data is modulated stepwise by the gray level change amount decreased in each step, so that the luminance change is not recognized in pixels at the boundary.

If the pixel shift period SHP is set within the 11 to 20 frame periods, when the target gray level is in the low gray level section (0 to 63), the difference in gray level up to the target gray level is equally divided into 4 steps, and when the target gray level is in the middle gray level section (64 to 127), the difference in gray level up to the target gray level is equally divided into 6 steps. And when the target gray level is in the high gray level section (128 to 255), the difference in gray level up to the target gray level is equally divided into 8 steps.

If the pixel shift period SHP is set within the 21 to 30 frame periods, when the target gray level is in the low gray level section (0 to 63), the difference in gray level up to the target gray level is equally divided into 6 steps, and when the target gray level is in the middle gray level section (64 to 127), the difference in gray level up to the target gray level is divided equally into 8 steps. And when the target gray level is the high gray level section (128 to 255), the difference in gray level up to the target gray level is equally divided into 10 steps.

Figure 19:
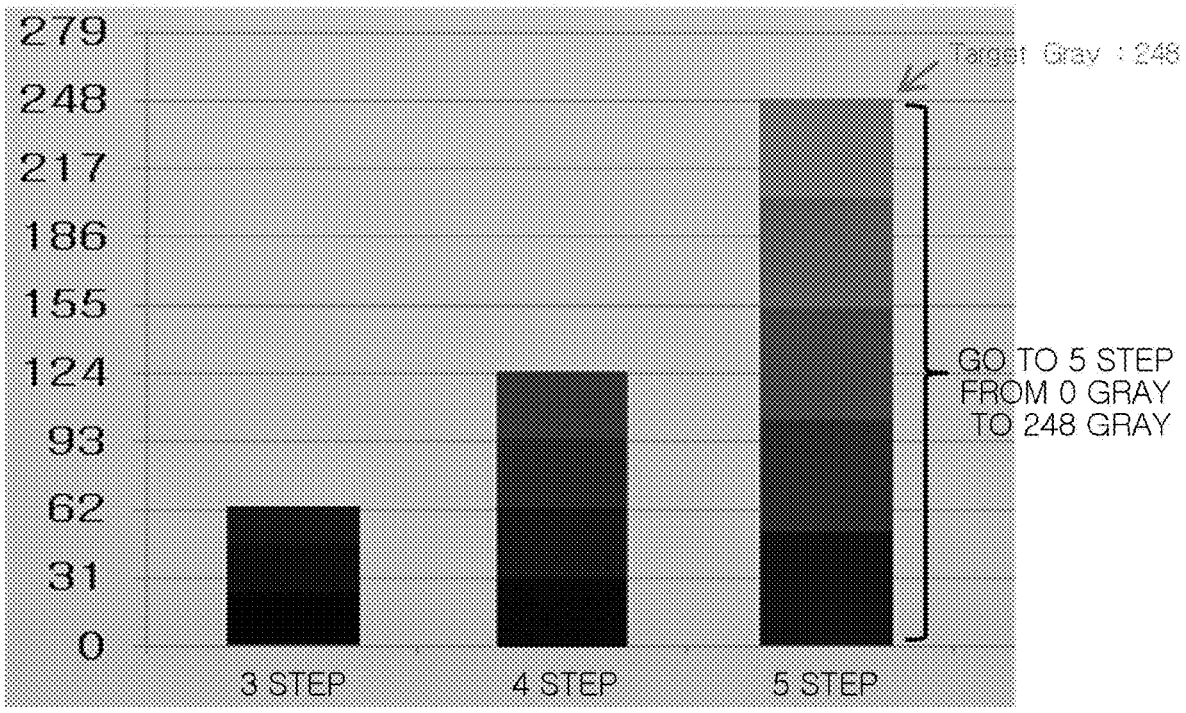
FIG. 19 is a diagram showing a gray level dividing step that varies according to a target gray level during a 1 pixel shift period.

FIG. 19 is a diagram illustrating an example of the gray level dividing steps that vary according to a target gray level during 1 pixel shift period.

Referring to FIG. 19, 1 pixel shift period SHP may be set to 30 frame period. If the target gray level is 124, the look-up table may select the gray level dividing step as 4 steps. In this case, the gray level value of the pixel data to be written in the dummy pixel is increased by 31 in each step for 30 frame periods, and reaches the target gray level 124 after 4 step modulation. If the target gray level is 248, the look-up table may select the gray level dividing step as 5 steps. In this case, the gray level value of the pixel data to be written in the dummy pixel is increased by 49.6 in each step for 30 frame period, and reaches the target gray level 248 after 5 step modulation.

Figure 20:
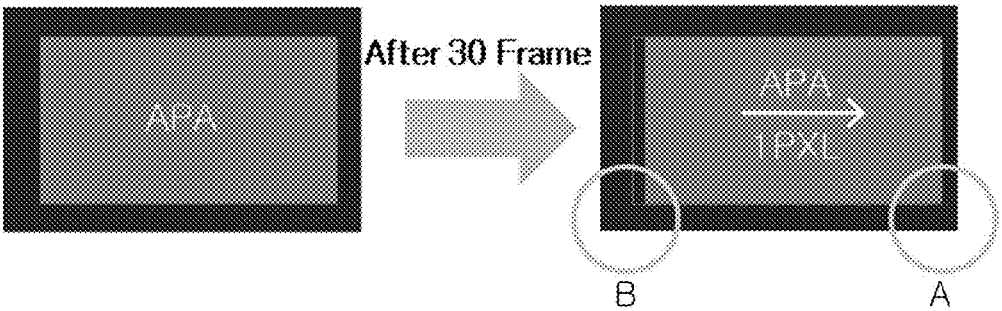
FIG. 20 is a diagram illustrating an example in which an active pixel region is shifted by 1 pixel to the right.
Figure 21A:
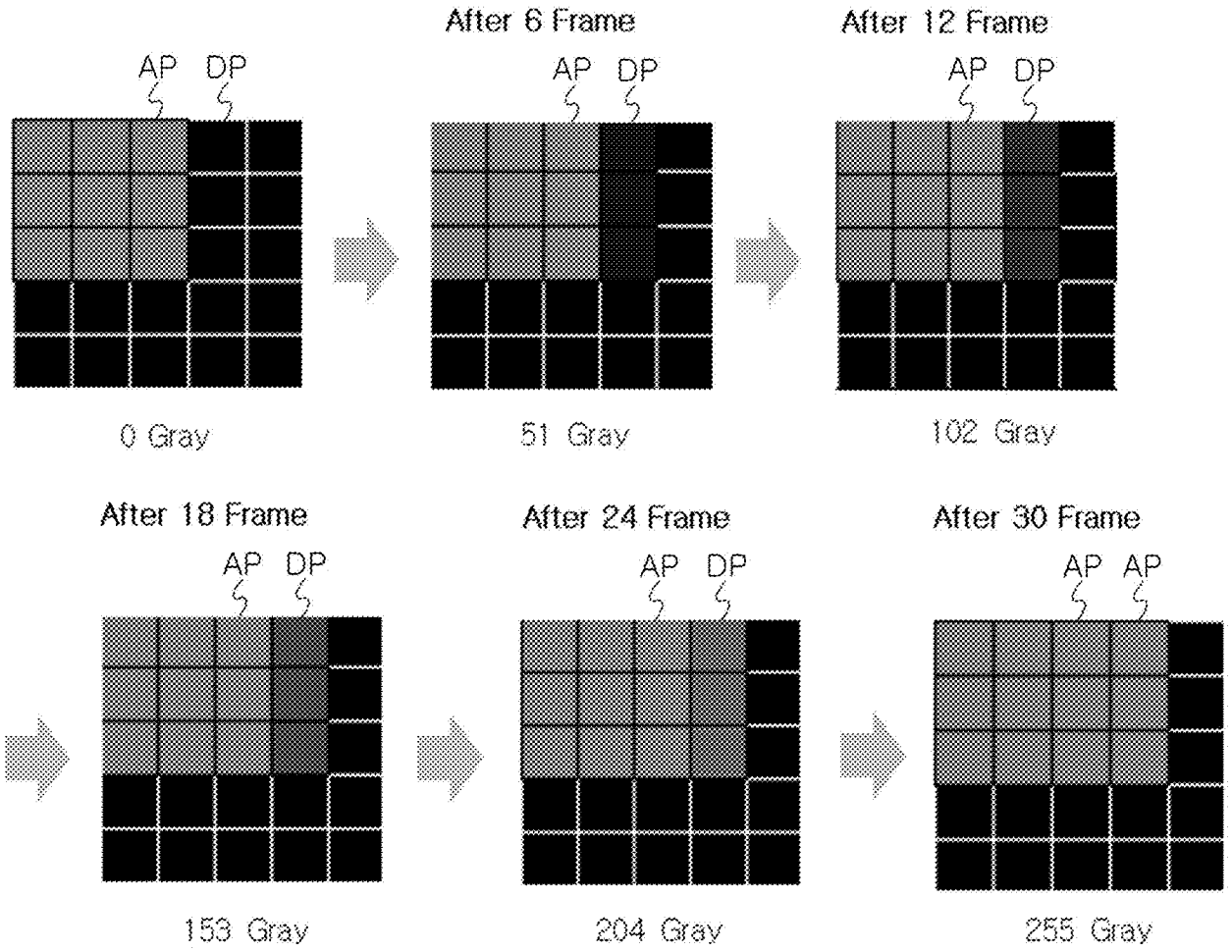
FIGS. 21A and 21B are diagrams illustrating an example in which a target gray level is subdivided into five steps by enlarging portions A and B shown in FIG. 20 to gradually change the gray level of pixel data.
Figure 21B:
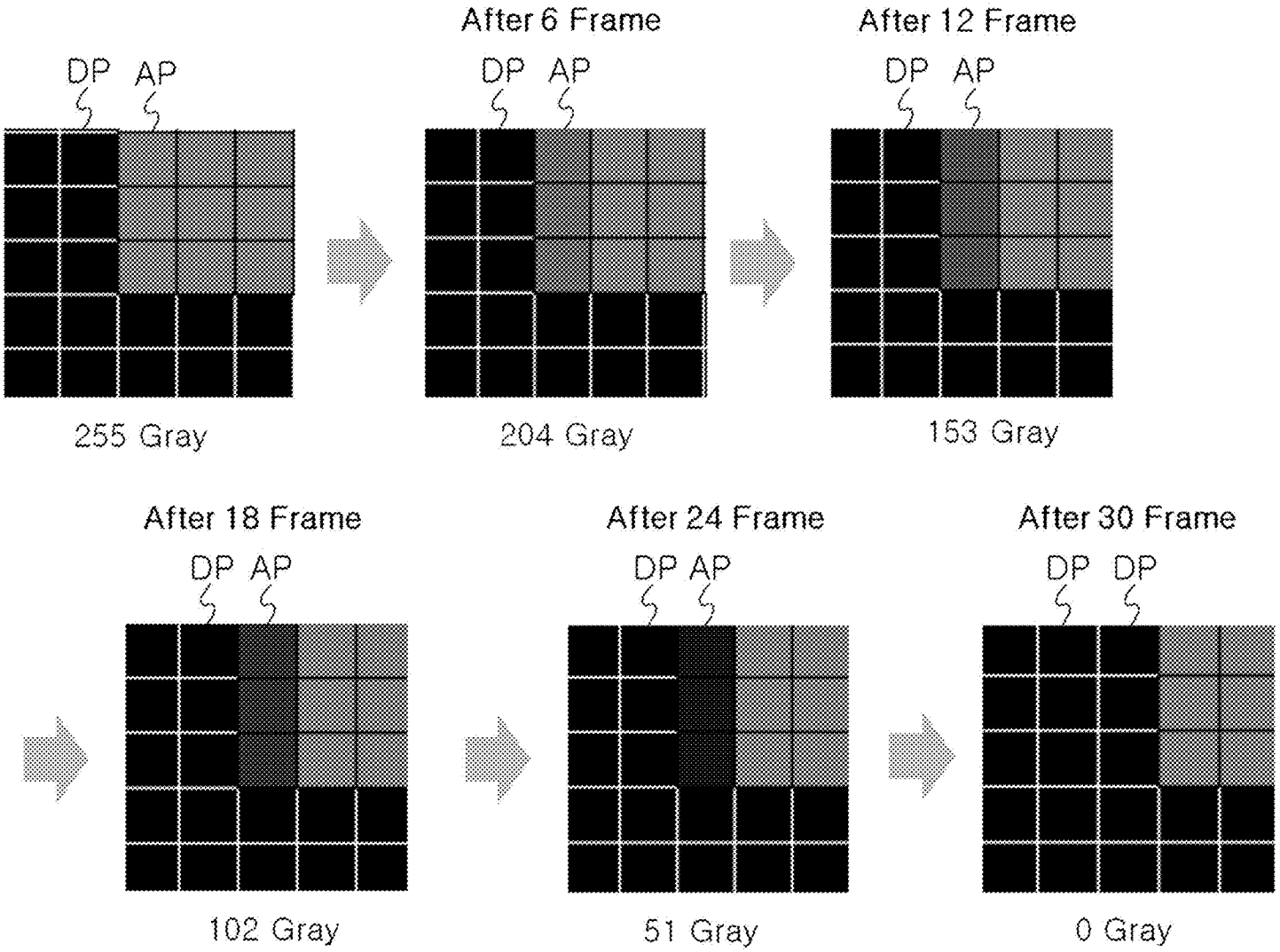

FIG. 20 is a diagram illustrating an example in which an active pixel region APA is shifted by 1 pixel to the right. In FIG. 20, a red image is displayed in the active pixel region. In the red region, the gray level of red data to be written to the red sub-pixels is a white gray level, that is, 255. The dummy pixels display black by applying a data voltage of black gray level data. FIG. 21A is an enlarged view of a right corner portion A shown in FIG. 20. FIG. 21B is an enlarged view of a left corner portion B shown in FIG. 20. In FIGS. 21A and 21B, "AP" is an active pixel. "DP1" and "DP2" are dummy pixels.

Referring to FIG. 21A, during one pixel shift period (30 frame), the gray level of the dummy pixel DP adjacent to the active pixel AP is gradually increased by 51 over 5 steps and the target gray level 255 is reached when reaching 30 frames. The gray level value of the pixel data applied to the dummy pixel DP is gradually increased from 0 to 51 in the first step, from 51 to 102 in the second step, from 102 to 153 in the third step, from 153 to 204 in the fourth step, and from 204 to 255, which is the target gray level in the fifth step and slowly changed to the active pixel AP.

Referring to FIG. 21B, during one pixel shift period (30 frame), the gray level of the active pixel AP at the boundary adjacent to the dummy pixel DP is gradually decreased by 51 over 5 steps and the target gray level 0 is reached when reaching 30 frame. The gray level value of the pixel data applied to the active pixel DP at the boundary is gradually decreased from 255 to 204 in the first step, from 204 to 153 in the second step, from 153 to 102 in the third step, from 102 to 51 in the fourth step, and from 51 to 0, which is the target gray level in the fifth step and slowly changed to the dummy pixel DP.

Figure 21C:
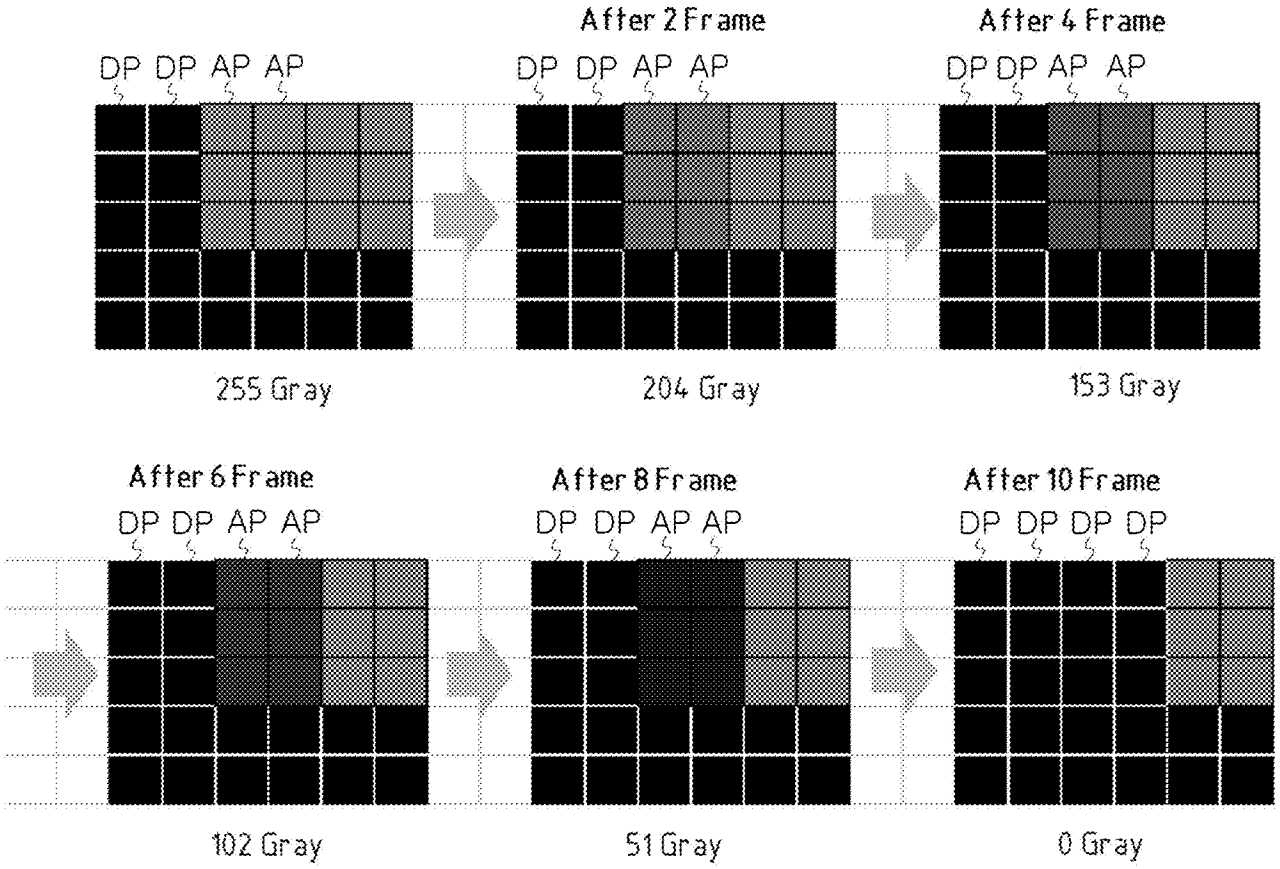
FIG. 21C is a diagram illustrating an example in which the gray level of pixel data gradually changes when a pixel shift amount is increased to 2 pixels by enlarging the portion illustrated in FIG. 20.

FIG. 21C is a diagram illustrating an example in which the gray level of pixel data gradually changes when the pixel shift amount is increased to 2 pixels by enlarging the portion illustrated in FIG. 20.

Referring to FIG. 21C, during one pixel shift period (30 frame), the gray levels of two adjacent active pixels AP at the boundary is gradually changed to reach a target gray level of 0, and changed to dummy pixels DP. In the example of FIG. 21C, when the active pixel region APA is shifted by 2 pixels, the gray level of the active pixels AP is changed to 5 steps, but is not limited thereto. For example, when the pixel shift period of the active pixel region APA is 30 frames and the gray level is changed from 255 to 0, if the pixel shift amount is increased, the gray level dividing step STEP is further subdivided so that the gray level of the active pixels AP located at the boundary is changed to 6 steps as set in FIG. 18. Thus, the gray level of the active pixels AP may be changed stepwise by the gray level change amount (42.5 gray levels) decreased in each step.

During the pixel shift period SHP, the active pixel region APA may be shifted while changing a preset (or selected) pixel shift direction as shown in FIGS. 9 to 11. In this case, during the pixel shift period SHP, as the shift direction of the active pixel region APA is changed, the gray level value of the pixels gradually is reached the target gray level. Thus, the probability that the user perceives the movement of the image may be further lowered.

The timing controller 130 may transmit data together with a clock to the data driving unit 110 through the same wiring. For example, the clock and data generated by the timing controller 130 may be encoded in a data format defined in an Embedded Clock Point to Point Interface (EPI) interface protocol and transmitted to the data driving unit 110.

In the EPI interface, the data driving unit 110 multiplies a clock inputted from the timing controller 130 and restores the clock to generate an internal clock for sampling data. The timing controller 130 transmits a preamble clock or a clock training pattern clock to the data driving unit 110 so that the phase of the restored clock in the data driving unit 110 may be locked.

Figure 22:
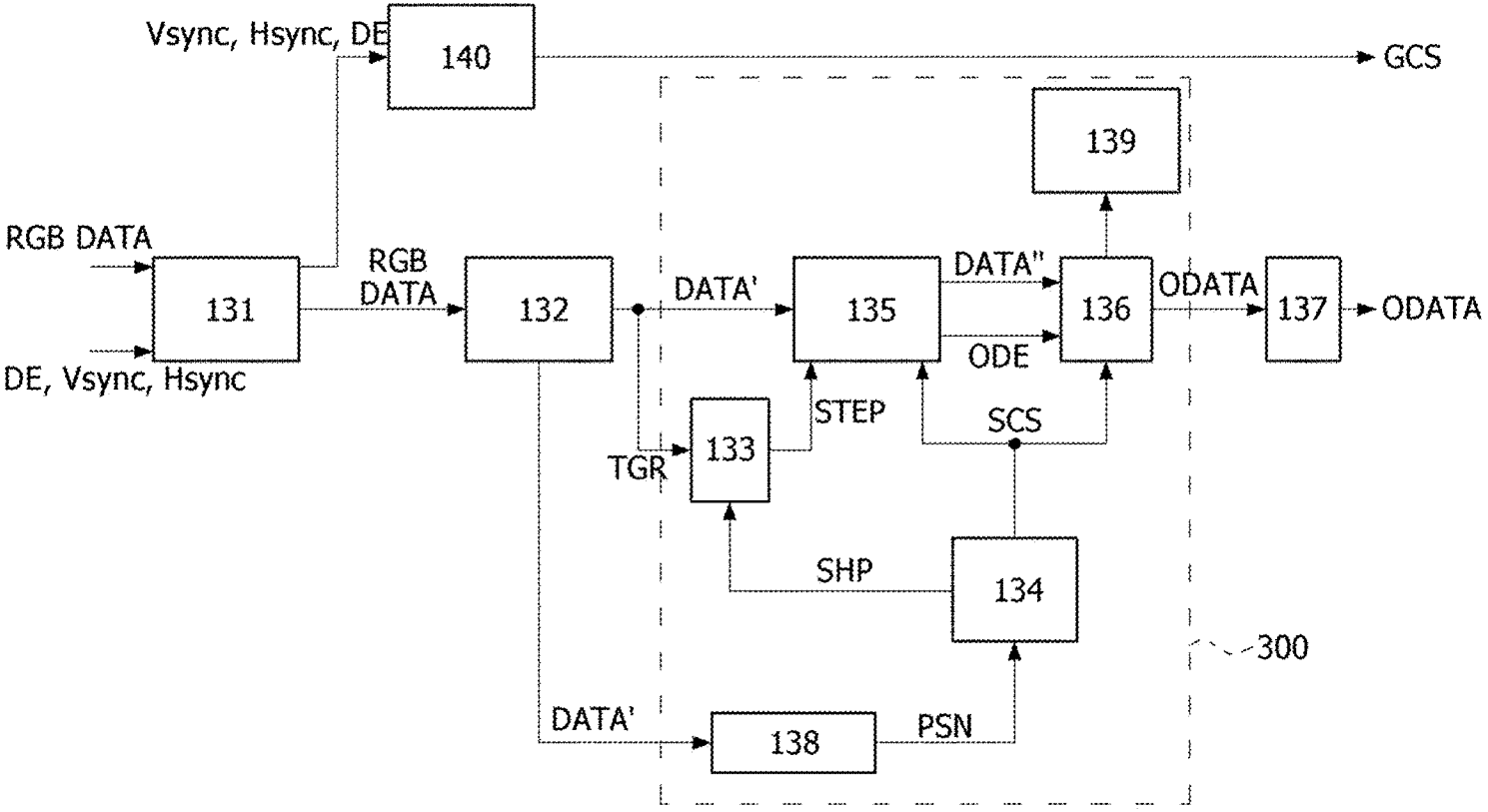
FIG. 22 is a block diagram showing in detail a timing controller according to an embodiment of the present disclosure.

FIG. 22 is a block diagram showing in detail a timing controller according to an embodiment of the present disclosure.

Referring to FIG. 22, the timing controller 130 includes a data receiving unit 131, a data processing unit 132, a pixel shift processing unit 300, and a data transmission unit 137. The timing controller 130 further includes a gate control unit 140 for outputting a gate timing control signal.

The data receiving unit 131 receives pixel data RGB DATA of an input image from the host system 200 and timing signals DE, Vsync, and Hsync synchronized with the data RGB DATA. The data receiving unit 131 may receive the pixel data RGB DATA and the timing signals DE, Vsync, and Hsync through a standard interface, for example, an embedded display port (eDP).

The data processing unit 132 may rearrange the pixel data RGB DATA received from the host system 200 according to the pixel arrangement of the display panel and the color arrangement of sub-pixels and supply the rearranged pixel data to the pixel shift processing unit 300. The data processing unit 132 may include a data calculating unit connected to an external compensation circuit. The data calculating unit may select a compensation value according to the sensing data input from the ADC and add or multiply the compensation value to the pixel data, such that the pixel data RGB DATA may be modulated.

The pixel shift processing unit 300 adds data to be written to the dummy pixel to the pixel data DATA, and shifts the pixel data DATA, so that the image displayed in the active pixel region APA is shifted within the size of the dummy pixel region DPA.

When the active pixel region APA is shifted, the pixel shift processing unit 300 divides the gray level of pixel data to be written to the dummy pixel by a gray level dividing step STEP to lower the gray level change amount, and stepwise accumulates the gray level change amount in the pixel data during the period defined in the pixel shift period SHP, such that the gray level of the dummy pixel may be gradually increased up to the target gray level TGR. At the same time, the gray level of data to be written to the active pixel located on the opposite side of the shift direction of the active pixel region APA is divided by the gray level dividing step STEP to lower the gray level change amount, and during the period defined by the pixel shift period SHP, the gray level change amount is stepwise accumulated in the pixel data to gradually decrease the gray level of the active pixel up to the black gray level.

The pixel shift processing unit 300 adds data to be written to a dummy pixel (black gray level data) to the pixel data DATA' received from the data processing unit 132 to thereby set a dummy pixel region outside the active pixel region APA. The pixel shift processing unit 300 sets a target gray level TGR as a gray level value of the pixel data DATA' received from the data processing unit 132 and sets a pixel shift period SHP. The pixel shift period SHP may be varied according to the analysis result of the input image. The pixel shift processing unit 300 selects the gray level dividing step STEP based on the target gray level TGR and the pixel shift period SHP to shift the active pixel region APA. In this case, the pixel shift processing unit 300 divides the gray level value of pixel data to be written in the active pixel and dummy pixel by the gray level dividing step STEP, such that the gray level value may be gradually increased or decreased up to the target gray level.

The pixel shift processing unit 300 may shift the pixel data by a preset (or selected) pixel shift amount for each pixel shift period SHP to shift the active pixel region APA. The pixel shift processing unit 300 may vary the pixel shift amount according to the complexity of the input image.

The pixel shift processing unit 300 may lower the pixel shift amount as the complexity of the input image increases. Therefore, when the complexity of the input image is changed, the pixel shift amount may be changed.

The pixel shift processing unit 300 may shift the active pixel region APA in a preset (or selected) pixel shift direction as illustrated in FIGS. 9 to 11.

The pixel shift processing unit 300 includes a look-up table 133, a shift control unit 134, a pixel shift unit 135, a line shift unit 136, an image analysis unit 138, and a buffer memory 139.

The look-up table 133 receives pixel data DATA' from the data processing unit 132 as a target gray level, and receives the pixel shift period SHP from the shift control unit 134. As shown in FIG. 17, the look-up table 133 receives the pixel shift period SHP and the target gray level TGR and outputs the gray level dividing step STEP. Meanwhile, when the pixel shift amount is increased, for example, when the pixel data is shifted to 2 pixels, a look-up table (FIG. 18) in which the gray level dividing step is further subdivided may be added.

The image analysis unit 138 determines the complexity of the image based on the gray level distribution of the input image, and compares the previous image data with the currently input image data to determine the motion of the input image. The image analysis unit 138 may supply a signal PSN including information of at least one of the pixel shift amount and the pixel shift period to the shift control unit 134 based on an analysis result of the input image.

The shift control unit 134 sets a pixel shift period SHP, a pixel shift amount, and a pixel shift direction. The shift control unit 134 may select the pixel shift period SHP and the pixel shift amount based on the analysis result of the input image input from the image analysis unit 138. The pixel shift direction may be set in advance as in the examples of FIGS. 9 to 11, but is not limited thereto. The shift control unit 134 may supply a shift control signal SCS to the pixel shift unit 135 and the line shift unit 136 to control a shift amount and a shift direction of data written to the active pixel and the dummy pixel. The shift control signal SCS includes information of the pixel shift amount and the shift direction.

The shift control unit 134 may vary at least one of the pixel shift period SHP and the pixel shift amount according to the analysis result of the input image.

The pixel shift unit 135 merges the dummy data (black gray level data) to be written in the dummy pixel to the pixel data DATA' received from the data processing unit 132 and adds a data enable pulse synchronized with the dummy data. When the active pixel region APA is shifted, the pixel shift unit 135 gradually changes the gray level values of data to be written to the dummy pixel and the active pixel during a period defined by the pixel shift period SHP and shifts the active pixel region and the dummy pixel region along a first direction (X-axis direction of FIG. 1).

When the active pixel region APA is shifted, the pixel shift unit 135 may gradually change the gray level value up to the target gray level only for pixel data to be written to pixels at the boundary between the active pixel region APA and the dummy pixel region DPA. The pixels at the boundary include one or more active pixels and one or more dummy pixels adjacent to the upper and lower, left and right edges of the one or more active pixel regions APA.

The pixel shift unit 135 increases gradually the gray level value of pixel data to be written in the dummy pixel by a gray level change amount obtained by dividing a gray level difference between a current gray level of data to be written in a dummy pixel and a target gray level by a gray level dividing step, during the period defined by the pixel shift period SHP. At the same time, the pixel shift unit 135 gradually decreases the gray level value of pixel data to be written to the active pixel by the gray level change amount obtained by dividing the gray level difference between the current gray level of the data to be written in the active pixel and the black gray level by the gray level dividing step, during the period defined by the pixel shift period SHP.

When the active pixel region APA is modulated, the pixel shift unit 135 supplies the modulated data DATA" and a modulated data enable signal ODE to which a pulse is added according to the addition of dummy data to the line shift unit 136.

The line shift unit 136 receives the modulated data DATA" from the pixel shift unit 135 and stores it in the buffer memory 139. The data DATA" includes pixel data to be written to an active pixel and black gray level data to be written to a dummy pixel. The line shift unit 136 shifts the modulated data in a second direction (Y-axis direction in FIG. 1) by a pixel shift amount in response to the shift control signal SCS. The buffer memory 139 may be set as a line memory having a capacity in consideration of a maximum shift amount in the second direction. For example, if the line data is shifted by a maximum of 8 lines in the second direction, the buffer memory 139 may be implemented as an 8-line memory in which 8-line data may be stored.

The data transmission unit 137 transmits data ODATA from the line shift unit 136 to the data driving unit 110 in a data transmission method conforming to the protocol of an interface for data communication between the timing controller 130 and the data driving unit 110, for example, an EPI interface. The data driving unit 110 inputs the pixel data received through the EPI interface to the DAC, converts pixel data to be written to the active pixel and black gray level data to be written to the dummy pixel into a data voltage to be output to the data lines of the active pixel region APA and the dummy pixel region DPA.

The gate control unit 140 counts the timing signals DE, Vsync, and Hsync, to generate a gate timing control signal GCS with a preset (or selected) gate timing control value.

Figure 23:
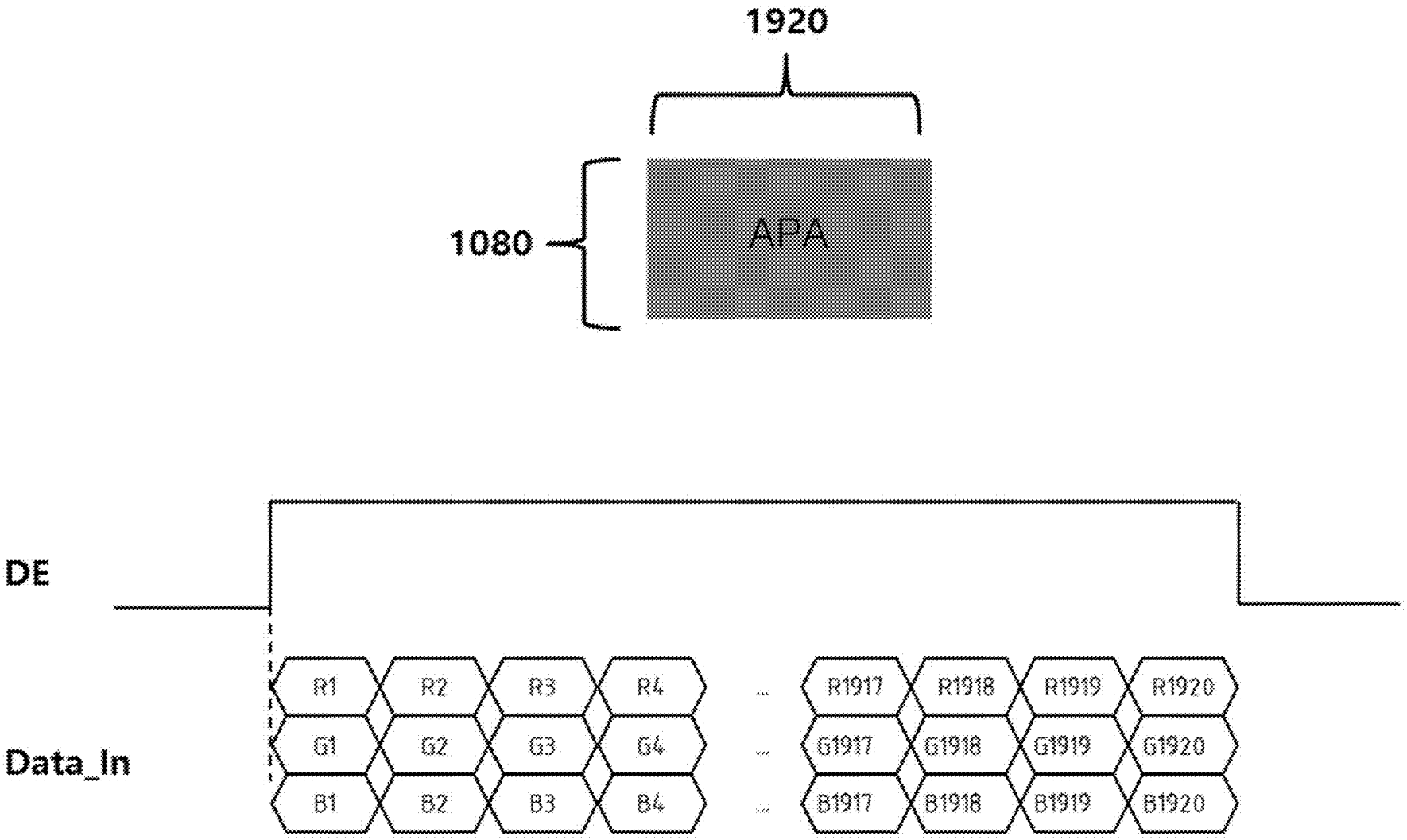
FIG. 23 is a diagram showing pixel data of an input image and a data enable signal inputted to a timing controller for one horizontal period.
Figure 24A:
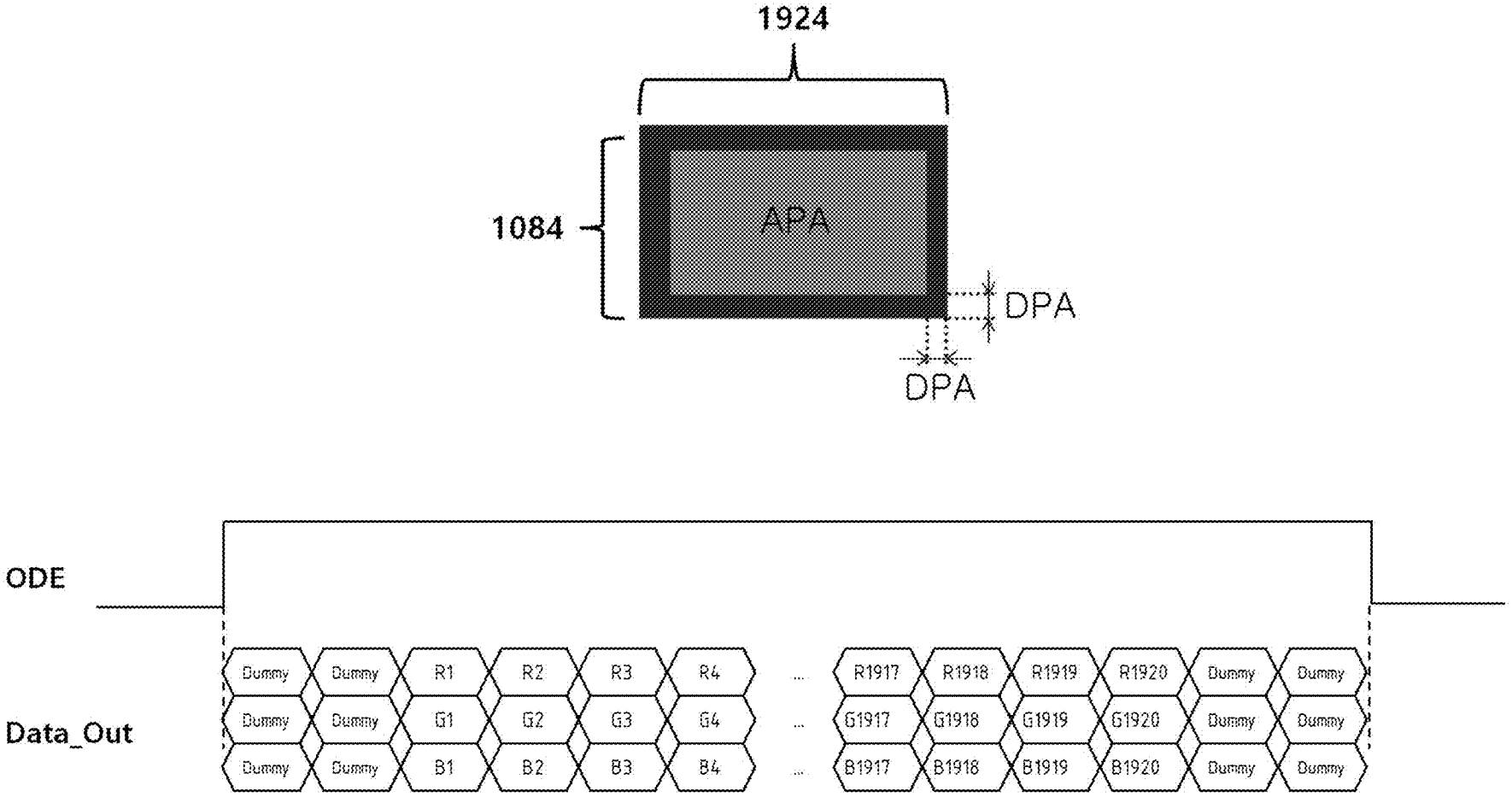
FIGS. 24A to 24C are diagrams illustrating added dummy data and a modulated data enable signal in order to shift an active pixel region in a first direction (horizontal direction)
Figure 24B:
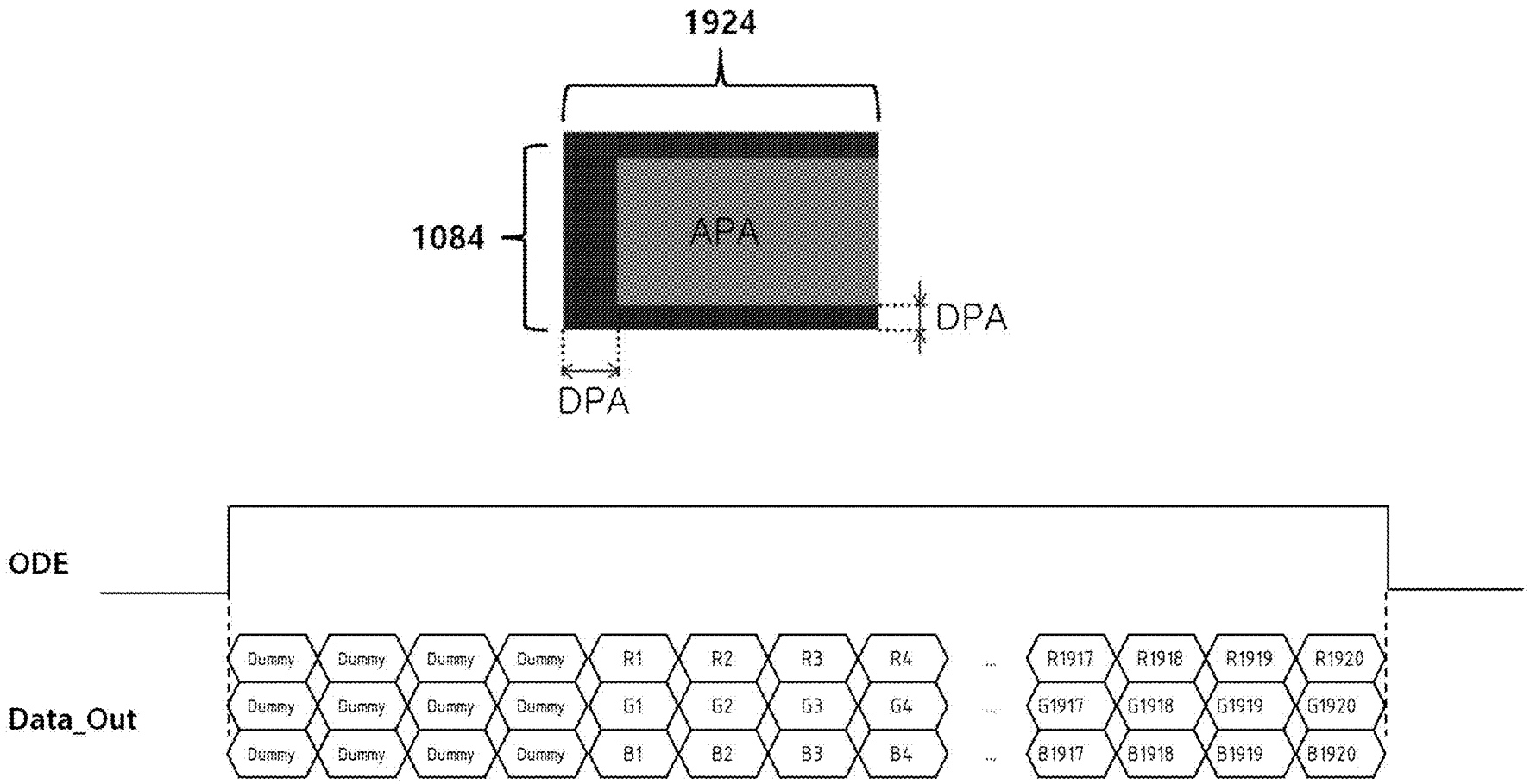
Figure 24C:
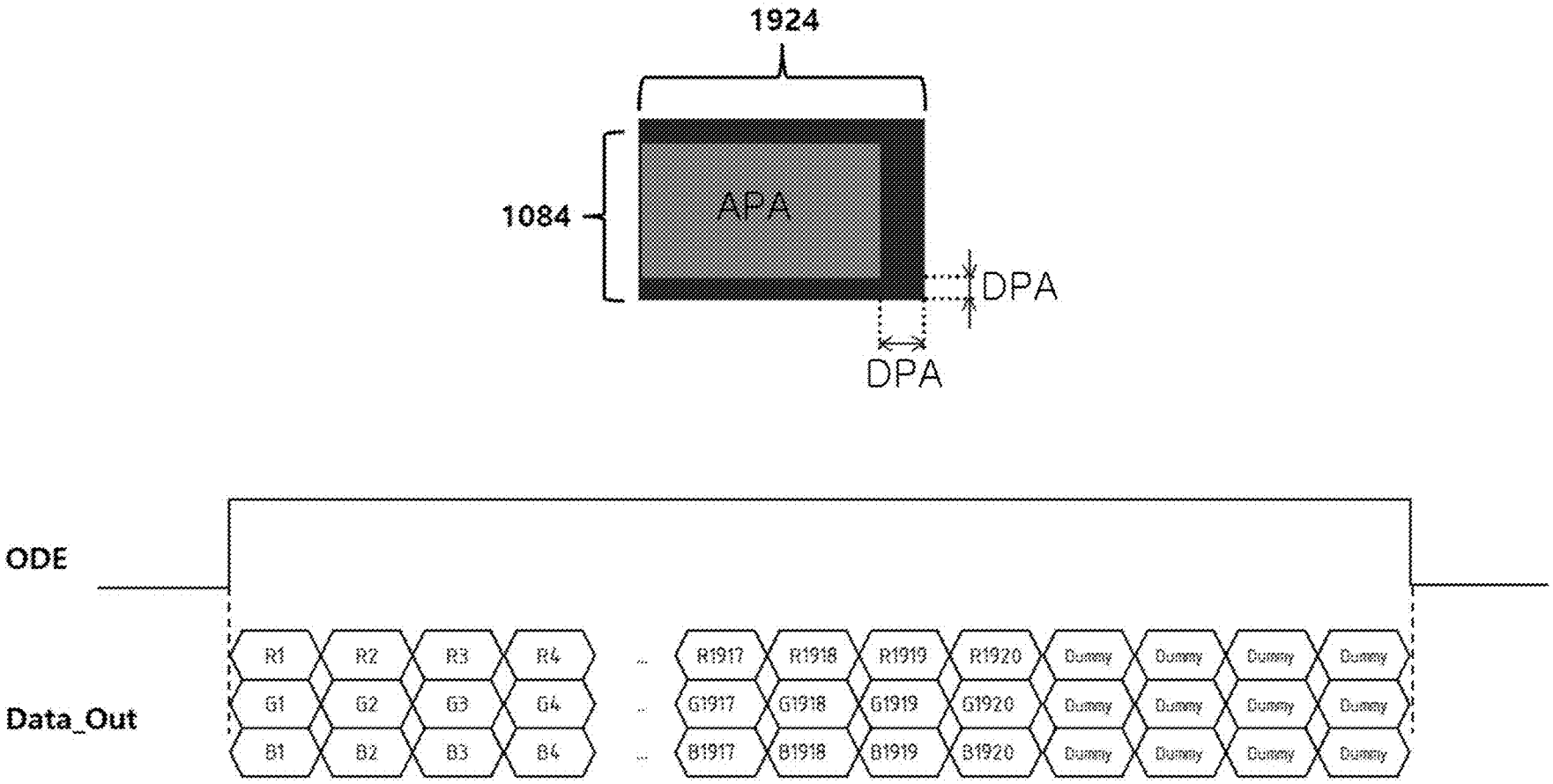

FIG. 23 is a diagram showing pixel data of an input image and a data enable signal input to the timing controller 130 during one horizontal period. FIGS. 24A to 24C are diagrams illustrating added dummy data and a modulated data enable signal in order to shift the active pixel region APA in the first direction (horizontal direction).

Referring to FIG. 23, image data Data_In input to the timing controller 130 may be data scaled to match the resolution of the active pixel region APA. The resolution of this image data may be 1920*1080. In FIG. 23, within one pulse of the data enable signal DE, one-line data to be written to one-pixel line of the active pixel region APA is synchronized. In one-line data, "R1 to R1920" are pixel data to be written to red pixels, and "G1 to G1920" are pixel data to be written to green pixels. And, "B1 to B1920" are pixel data to be written to the blue pixels.

The timing controller 130 may add dummy data to the pixel data to be written to the active pixel region APA as shown in FIG. 24A such that the active pixel region APA may be shifted within the pixel array, the modulated data enable signal ODE to which a pulse is added may be synchronized with the dummy data. The active pixel region APA may be shifted left or right along the first direction as shown in FIGS. 24B and 24C within the size of the dummy pixel regions DPA on the left and right sides.

Figure 25:
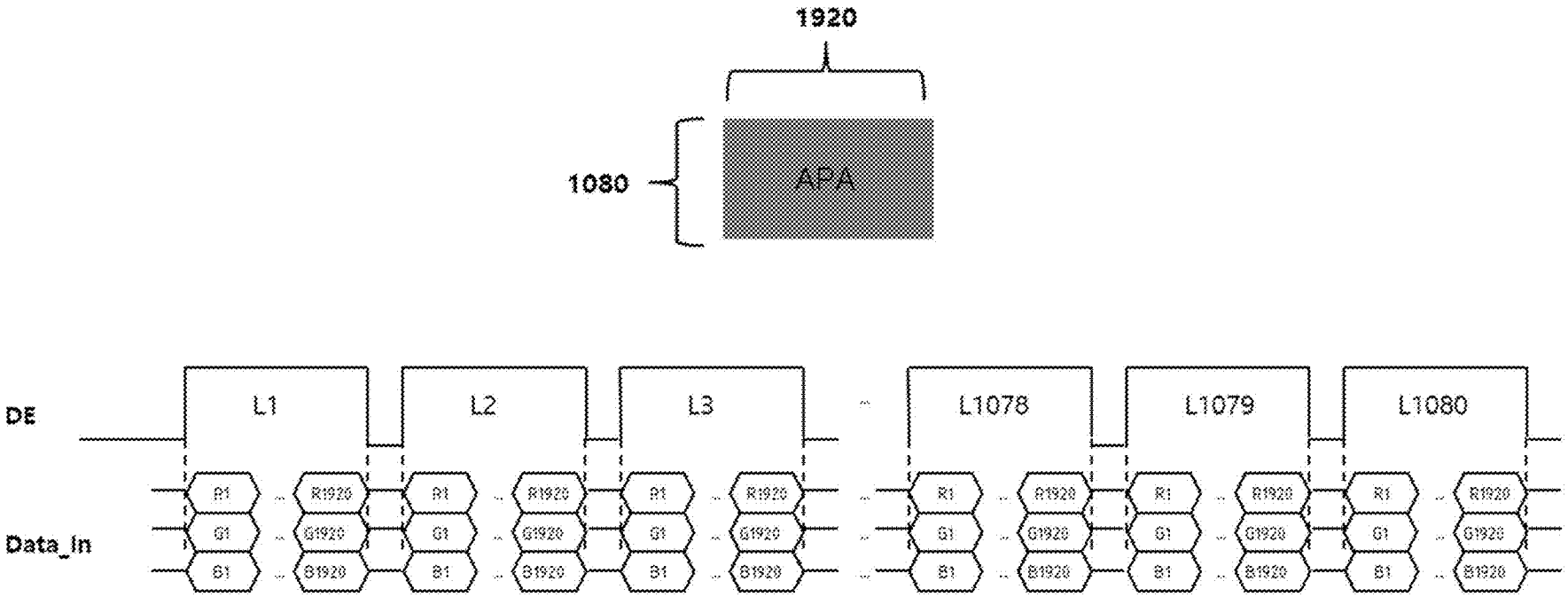
FIG. 25 is a diagram showing pixel data of an input image inputted to a timing controller for one vertical period and a data enable signal.
Figure 26A:
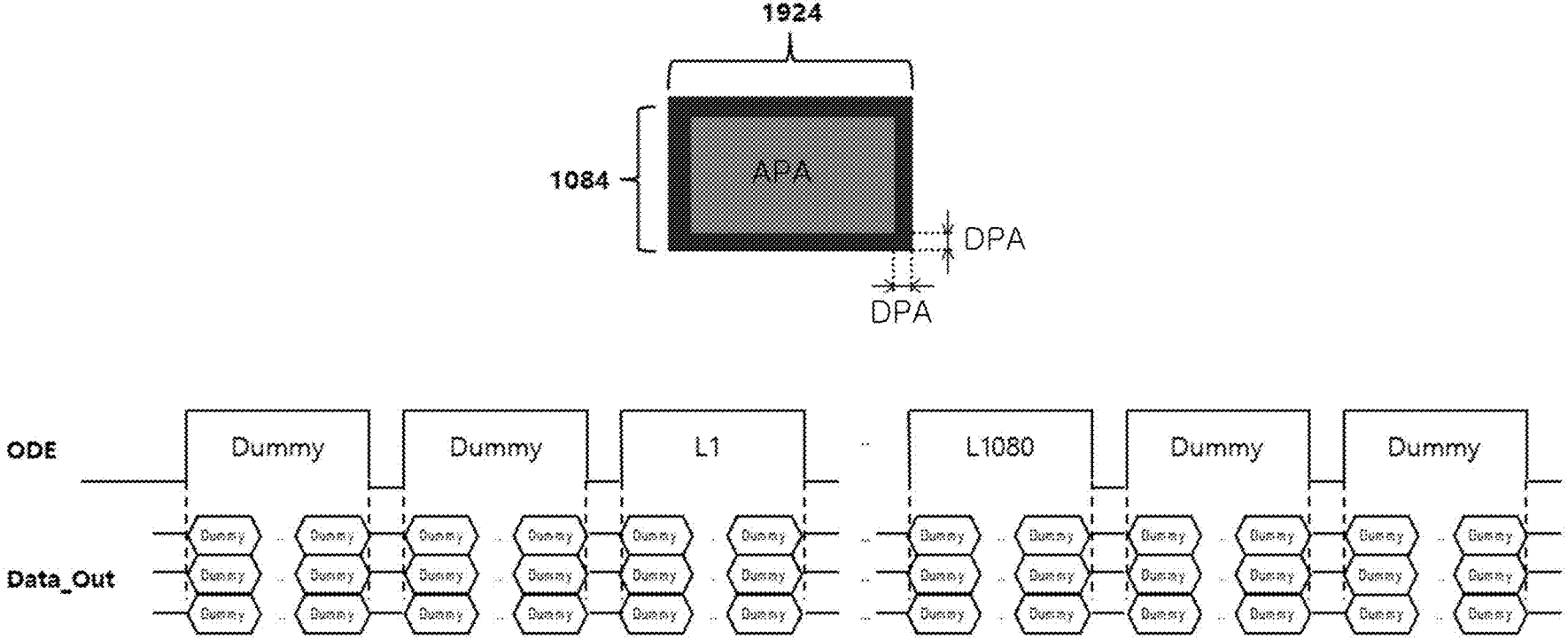
FIGS. 26A to 26C are diagrams showing added dummy data and a modulated data enable signal in order to shift an active pixel region in a second direction (vertical direction).
Figure 26B:
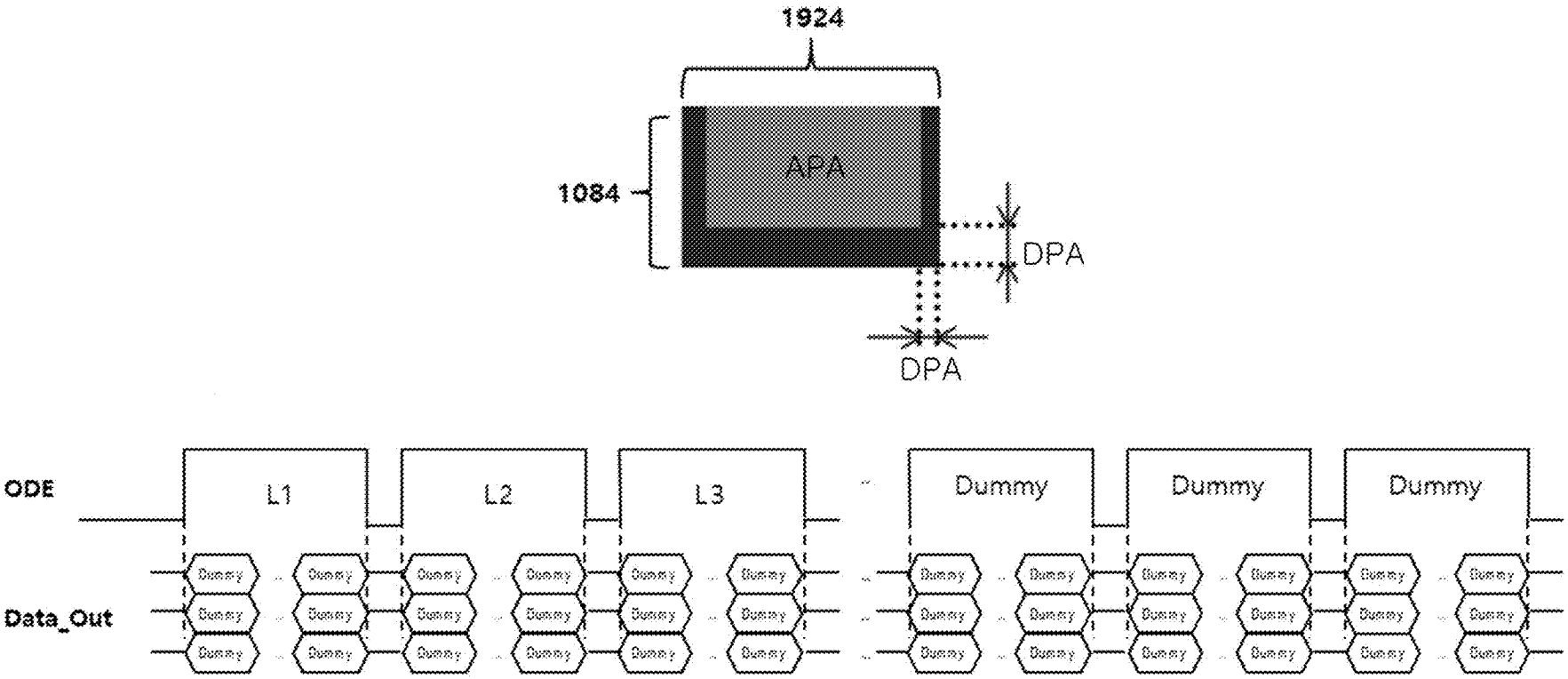
Figure 26C:
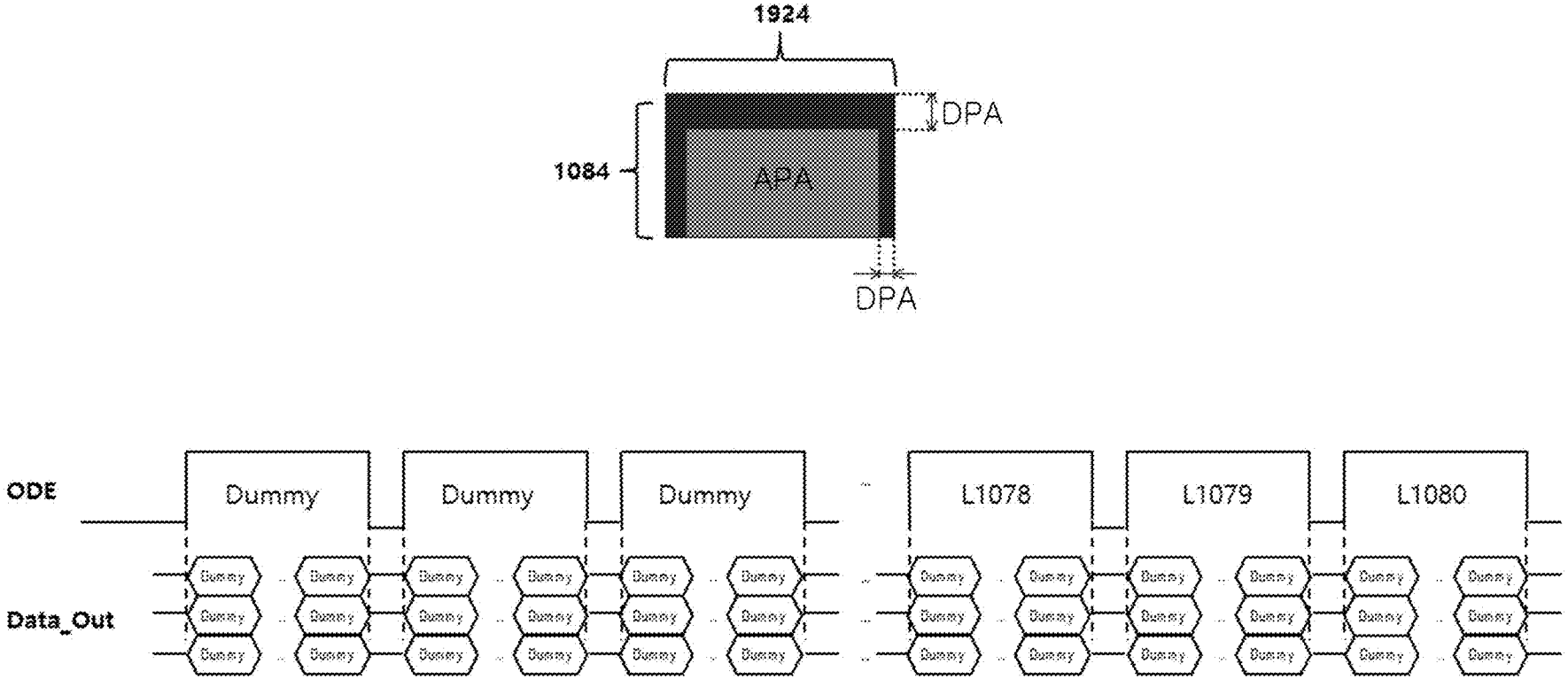

FIG. 25 is a diagram showing pixel data of an input image and a data enable signal input to a timing controller during one vertical period (or frame period). FIGS. 26A to 26C are diagrams showing added dummy data and a modulated data enable signal in order to shift the active pixel region in the second direction (vertical direction).

Referring to FIG. 25, image data Data-In for one frame is input to the timing controller 130 during one frame period. In FIG. 25, one-line data is synchronized within one pulse of the data enable signal DE. Accordingly, during one frame period, the line data corresponding to the vertical resolution of the active pixel region APA, for example, pixel data of the first to 1080th pixel lines L1 to L1080 is input to the timing controller 130.

The timing controller 130 adds dummy data to the pixel data to be written in the active pixel region APA as shown in FIG. 26A such that the active pixel region APA may be shifted within the pixel array, and the modulated data enable signal ODE to which a pulse is added may be synchronized with the dummy data. The number of pulses added from the modulated data enable signal ODE is equal to the number of dummy lines to be written to the pixels of the dummy pixel lines of the dummy regions DPA on an upper portion and lower portion of the pixel array AA. The active pixel region APA may be shifted up and down along the second direction as shown in FIGS. 26B and 26C within the size of the dummy pixel region DPA added outside the upper and lower ends of the active region APA.

The technical benefits to be achieved by the present disclosure, the means for achieving the benefits, and effects of the present disclosure described above do not specify essential features of the claims, and thus, the scope of the claims is not limited to the disclosure of the present disclosure.

Although the embodiments of the present disclosure have been described in more detail with reference to the accompanying drawings, the present disclosure is not limited thereto and may be embodied in many different forms without departing from the technical concept of the present disclosure. Therefore, the embodiments disclosed in the present disclosure are provided for illustrative purposes only and are not intended to limit the technical concept of the present disclosure. The scope of the technical concept of the present disclosure is not limited thereto. Therefore, it should be understood that the above-described embodiments are illustrative in all aspects and do not limit the present disclosure. The protective scope of the present disclosure should be construed based on the following claims, and all the technical concepts in the equivalent scope thereof should be construed as falling within the scope of the present disclosure.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A display device comprising:

a display panel including an active pixel region in which an input image is displayed and a dummy pixel region outside the active pixel region; and a pixel shift processing circuit configured to shift an image displayed in the active pixel region toward the dummy pixel region, wherein the pixel shift processing circuit gradually changes a gray level of at least one dummy pixel in the dummy pixel region adjacent to the active pixel region up to a target gray level of pixel data, and gradually changes a gray level of at least one active pixel of an active pixel adjacent to the dummy pixel region up to a black gray level when the active pixel region is shifted, wherein the pixel shift processing circuit lowers a pixel shift amount as a complexity of the input image increases, and wherein the pixel shift processing circuit increases the number of divided gray levels when the pixel shift amount increases.

2. The display device of claim 1, wherein the pixel shift processing circuit sets a pixel shift period defining a period reaching the target gray level, and determines a gray level dividing step of subdividing the target gray level.

3. The display device of claim 2, wherein the pixel shift period is determined to a selected value or is set based on an analysis result of the input image.

4. The display device of claim 3, wherein the pixel shift processing circuit sets the pixel shift period to a long period when the input image is a still image or the input image has a low complexity, and wherein the pixel shift processing circuit sets the pixel shift period to a relatively short period when the input image is a moving picture or the input image has a high complexity.

5. The display device of claim 2, wherein the pixel shift processing circuit divides a gray level of the pixel data to be written in the dummy pixel by the gray level dividing step to lower a first gray level change amount, and stepwise accumulates the first gray level change amount in the pixel data during a period defined in the pixel shift period to gradually increase the gray level of the dummy pixel up to the target gray level, and wherein the pixel shift processing circuit divides a gray level of data to be written in the active pixel by the gray level dividing step to lower a second gray level change amount, and stepwise accumulates the second gray level change amount in the pixel data during a period defined in the pixel shift period to gradually decrease the gray level of the active pixel up to the black gray level.

6. The display device of claim 2, wherein the pixel shift processing circuit sets the pixel shift amount based on a selected value or the complexity of the input image.

7. The display device of claim 2, wherein the pixel shift processing circuit sets a direction of the pixel shift.

8. The display device of claim 1, wherein the pixel shift processing circuit includes:

a shift control circuit configured to set a pixel shift period, the pixel shift amount, and a pixel shift direction;

a lookup table configured to receive the pixel data as the target gray level and receive a pixel shift period to output a gray level dividing step;

a pixel shift circuit configured to merge black gray level data to be written in the dummy pixel with the pixel data, gradually change a gray level value of data to be written in the dummy pixel and the active pixel during a period defined by the pixel shift period, and shift the active pixel region and the dummy pixel region along a first direction; and a line shift circuit configured to shift data modulated from the pixel shift circuit along the first direction.

9. The display device of claim 8, wherein the pixel shift processing circuit includes an image analysis circuit configured to analyze the input image, and wherein the shift control circuit varies at least one of the pixel shift period and the pixel shift amount according to the analysis result of the input image.

10. The display device of claim 8, further comprising a data driving circuit configured to convert data inputted from the pixel shift processing circuit into a data voltage and supply it to data lines of the active pixel region and data lines of the dummy pixel region.

11. An image processing method of a display device, comprising:

displaying an input image in an active pixel region;

displaying black gray level data in a dummy pixel region arranged outside the active pixel region;

gradually changing a gray level of at least one dummy pixel in the dummy pixel region adjacent to the active pixel region up to a target gray level of pixel data when the active pixel region is shifted;

gradually changing a gray level of at least one active pixel of an active pixel adjacent to the dummy pixel region up to a black gray level;

lowering a pixel shift amount as a complexity of the input image increases, and increasing the number of divided gray levels when the pixel shift amount increases.

12. The image processing method of claim 11, further comprising:

setting a pixel shift period reaching the target gray level; and determining a gray level dividing step of subdividing the target gray level.

13. The image processing method of claim 12, wherein gradually changing the gray level of the dummy pixel up to the target gray level of the pixel data includes:

dividing a gray level of the pixel data to be written in the dummy pixel by the gray level dividing step to lower a first gray level change amount, and stepwise accumulating the first gray level change amount in the pixel data during a period defined in the pixel shift period to gradually increase the gray level of the dummy pixel up to the target gray level.

14. The image processing method of claim 13, wherein gradually changing the gray level of the active pixel up to the black gray level includes:

dividing a gray level of data to be written in the active pixel by the gray level dividing step to lower a second gray level change amount, and stepwise accumulating the second gray level change amount in the pixel data during a period defined in the pixel shift period to gradually decrease the gray level of the active pixel up to the black gray level.

15. The image processing method of claim 12, wherein the pixel shift period is determined to a selected value or is set based on an analysis result of the input image.

16. The image processing method of claim 12, further comprising setting the pixel shift amount based on a selected value or the complexity of the input image.

17. The image processing method of claim 12, further comprising setting a direction of the pixel shift.

* * * * *